US006095566A

United States Patent [19]

Yamamoto et al.

[11] Patent Number: 6,095,566

[45] Date of Patent: *Aug. 1, 2000

[54] IMAGE RECORDED PRODUCT, IMAGE RECORDING SYSTEM, IMAGE REPRODUCING SYSTEM, AND RECORDING MEDIUM FOR USE TO SUPERIMPOSE-RECORD/REPRODUCE ADDITIONAL INFORMATION

[75] Inventors: Naofumi Yamamoto, Tokyo; Hidekazu Sekizawa; Haruko Kawakami, both of Yokohama; Kazuhiko Higuchi, Kawasaki, all of Japan

[73] Assignee: Kabushiki Kaisha Toshiba, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/816,309

[22] Filed: Mar. 13, 1997

[30] Foreign Application Priority Data

Mar. 14, 1996 [JP] Japan ..... 8-057529
Mar. 15, 1996 [JP] Japan ..... 8-059750

[51] Int. Cl.[7] ..... B42D 15/00

[52] U.S. Cl. ..... 283/75; 283/94; 283/107; 283/110; 283/112; 428/195; 428/913; 428/914

[58] Field of Search ..... 283/93, 94, 90, 283/91, 107–112, 75; 428/195, 913, 914

[56] References Cited

U.S. PATENT DOCUMENTS 5,344,808 9/1994 Watanabe et al. ..... 428/195 X
5,489,567 2/1996 Koshizuka et al. ..... 428/195 X

OTHER PUBLICATIONS

Eurocrypt '94, pp. 1–12, 1994, Moni Naor, et al., "Visual Cryptography".

Image Deep Cryptography (Method and Application), pp. 58–61, 1993, "Chapter III—Method of Utilizing Threshold Information" (with partial English translation).

"Visual Cryptographic Scheme of Information Through the Human Visual System", p. 126, 1995, Kazuhito Oka, et al. (With English translation).

*Primary Examiner*—Andrea L. Pitts
*Assistant Examiner*—Monica S. Carter
*Attorney, Agent, or Firm*—Oblon, Spivak, McClelland, Maier & Neustadt, P.C.

[57] ABSTRACT

An image recording system superimposes, on an original image, an additional image which is same as at least any one of visible characters, symbols and numerals recorded on a recorded product and records the superimposed image on the recorded product as an image for certification. The additional image superimpose-recorded on the recorded product cannot visually be recognized and it is permitted to be visible when a universal optical filter is used.

4 Claims, 20 Drawing Sheets

| y \ x | 0 | 1 | 2 | 3 | 4 | 5 | 6 | 7 |
|---|---|---|---|---|---|---|---|---|
| 0 | -1 | -1 | 1 | 1 | -1 | -1 | 1 | 1 |
| 1 | -1 | -1 | 1 | 1 | -1 | -1 | 1 | 1 |
| 2 | 1 | 1 | -1 | -1 | 1 | 1 | -1 | -1 |
| 3 | 1 | 1 | -1 | -1 | 1 | 1 | -1 | -1 |
| 4 | -1 | -1 | 1 | 1 | -1 | -1 | 1 | 1 |
| 5 | -1 | -1 | 1 | 1 | -1 | -1 | 1 | 1 |
| 6 | 1 | 1 | -1 | -1 | 1 | 1 | -1 | -1 |

| yi \ xi | −2 | −1 | 0 | 1 | 2 |
|---|---|---|---|---|---|
| −2 | 1 | 1 | 1 | 1 | 1 |
| −1 | 1 | 1 | 1 | 1 | 1 |
| 0 | 1 | 1 | 1 | 1 | 1 |
| 1 | 1 | 1 | 1 | 1 | 1 |
| 2 | 1 | 1 | 1 | 1 | 1 |

1/25

FIG. 20A

| yi \ xi | −2 | −1 | 0 | 1 | 2 |
|---|---|---|---|---|---|
| −1 | 1 | 1 | 1 | 1 | 1 |
| 0 | 1 | 1 | 1 | 1 | 1 |
| 1 | 1 | 1 | 1 | 1 | 1 |

1/15

FIG. 20B

| yi \ xi | −2 | −1 | 0 | 1 | 2 |
|---|---|---|---|---|---|
| 0 | 1 | 1 | 1 | 1 | 1 |

1/5

FIG. 20C

| yi \ xi | −2 | −1 | 0 | 1 | 2 |
|---|---|---|---|---|---|
| −2 | | 1 | 1 | 1 | |
| −1 | 1 | 1 | 1 | 1 | 1 |
| 0 | 1 | 1 | 1 | 1 | 1 |
| 1 | 1 | 1 | 1 | 1 | 1 |
| 2 | | 1 | 1 | 1 | |

1/21

FIG. 20D

| yi \ xi | −2 | −1 | 0 | 1 | 2 |
|---|---|---|---|---|---|
| −2 | 1 | 1 | 1 | 1 | 1 |
| −1 | 1 | 2 | 2 | 2 | 1 |
| 0 | 1 | 2 | 3 | 2 | 1 |
| 1 | 1 | 2 | 2 | 2 | 1 |
| 2 | 1 | 1 | 1 | 1 | 1 |

1/35

FIG. 20E

| y \ x | 0 | 1 | 2 | 3 | 4 | 5 | 6 | 7 |
|---|---|---|---|---|---|---|---|---|
| 0 | W | W | K | K | W | W | K | K |
| 1 | W | W | K | K | W | W | K | K |
| 2 | K | K | W | W | K | K | W | W |
| 3 | K | K | W | W | K | K | W | W |
| 4 | W | W | K | K | W | W | K | K |
| 5 | W | W | K | K | W | W | K | K |
| 6 | K | K | W | W | K | K | W | W |
FIG. 27
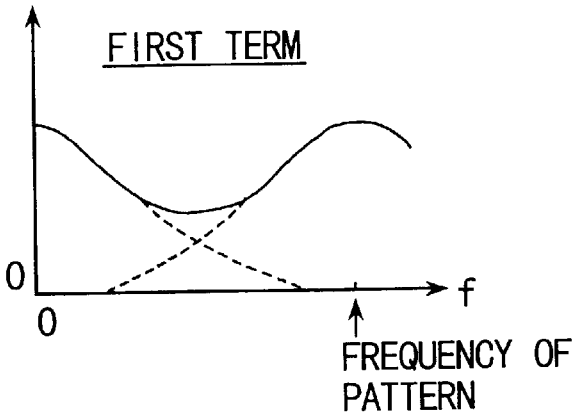
FIG. 28A
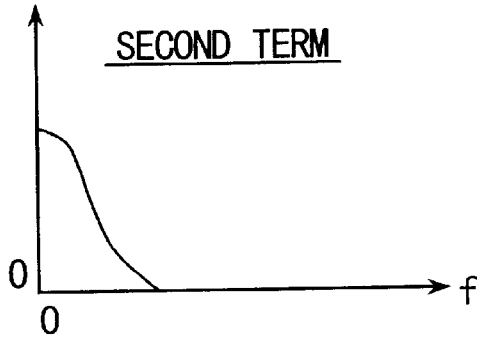
FIG. 28B
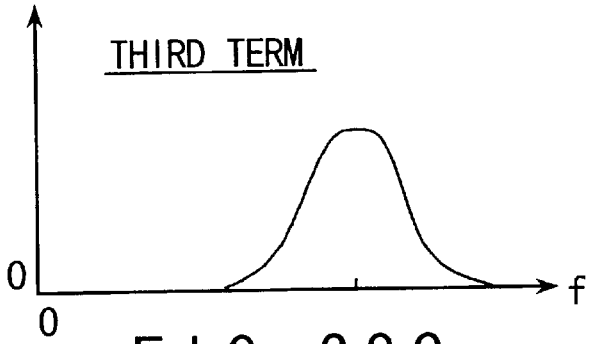
FIG. 28C

| y \ x | 0 | 1 | 2 | 3 | 4 | 5 | 6 | 7 |
|---|---|---|---|---|---|---|---|---|
| 0 | -1 | -1 | 1 | 1 | -1 | -1 | 1 | 1 |
| 1 | -1 | -1 | 1 | 1 | -1 | -1 | 1 | 1 |
| 2 | -1 | -1 | 1 | 1 | -1 | -1 | 1 | 1 |
| 3 | -1 | -1 | 1 | 1 | -1 | -1 | 1 | 1 |
| 4 | -1 | -1 | 1 | 1 | -1 | -1 | 1 | 1 |
| 5 | -1 | -1 | 1 | 1 | -1 | -1 | 1 | 1 |
| 6 | -1 | -1 | 1 | 1 | -1 | -1 | 1 | 1 |

FIG. 36
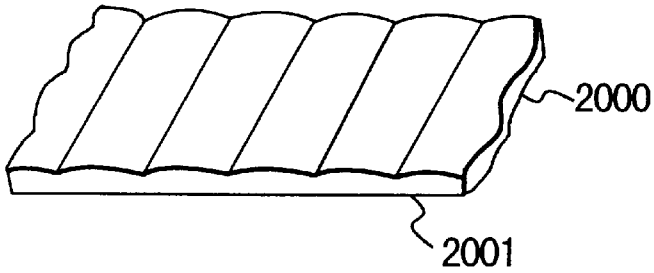
FIG. 37
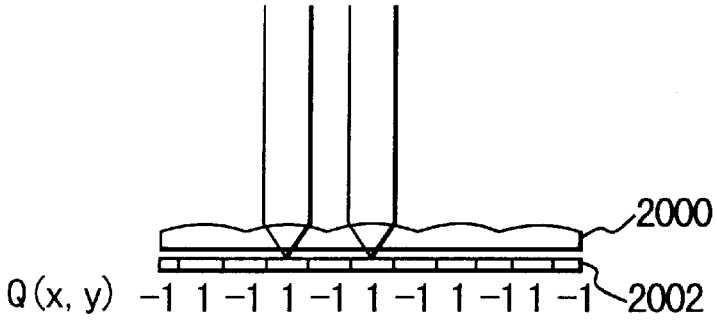
FIG. 38
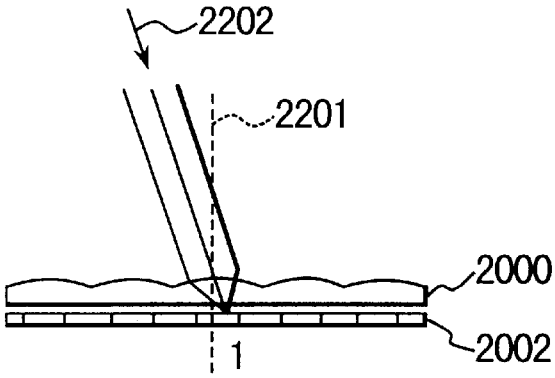
FIG. 39
| yi \ xi | −1 | 0 | 1 |
|---|---|---|---|
| −1 | 1/16 | 5/16 | 3/16 |
| 0 | 7/16 | 0 | 0 |
VALUE OF a(xi, yi)

IMAGE RECORDED PRODUCT, IMAGE RECORDING SYSTEM, IMAGE REPRODUCING SYSTEM, AND RECORDING MEDIUM FOR USE TO SUPERIMPOSE-RECORD/REPRODUCE ADDITIONAL INFORMATION

BACKGROUND OF THE INVENTION

The present invention relates to an image recorded product having a synthesized image formed by superimposing additional information on an original image, an image recording system for recording the synthesized image as a hard copy, an image reproducing system for reproducing the additional information from the recorded synthesized image and a recording medium which stores recording/reproducing procedure recorded thereon.

In recent years, image recording system, image reproducing system and so forth have been developed to be adaptable to a variety of methods in order to prevent falsification and forgery of an identification card (i.e., ID card) having a face picture or the like recorded as an image thereon, a document having a logotype or a seal impression recorded as an image thereon and another recorded product.

For example, a method in which a face picture is confirmed by a human being to specify a person is an easiest and reliable method. Thus, fact pictures are widely employed to be adaptable to certification cards, driving licenses, passports and ID cards. The foregoing method encounters a problem of forgery of an ID card. The certification cards and so forth have been arranged to prevent forgery by means of changing the face picture by employing a method of sectioning the seal into two leaves, a laminate process and an integration process by a special image recording system. However, a high-performance color scanner and a color printer can easily be obtained in recent years and combination with a personal computer has enabled forgery of a certification card having a face picture or the like to be performed.

Also the magnetic card and the IC card for use as a credit card can be forged with knowledge and technique capable of copying the magnetically recorded portion and rewriting the contents stored in the memory. Thus, even the foregoing structures are not completely safe structures. Therefore, the face picture, which is the easiest and reliable method for identifying whether or not the person having the medium is the proper owner, has been made to be more important. However, there is a risk that forgery by changing the face picture can be performed similarly to the certification card.

On the other hand, autograph is a usual method to indicate certification of the contents of a document in a usual office work. By confirming the impression, whether or not the document has been certificated by the proper person can be determined. However, the person who has received the certified document cannot easily properly determine the impression. Thus, a problem of inefficient office work must be performed. Moreover, the impression can be synthesized by combining the existing precise scanner, a printer and a personal computer. Although logotypes partially employed by a portion of companies to be used together with documents can easily be copied. There is a risk that a document having a logotype can be forged.

A variety of methods have been employed to prevent forgery and the like by superimpose-recording additional information on an original image and to reproduce the additional information superimpose-recorded on the original image. In order to prevent forgery of a hard copy, such as a certification card, the following methods are available:

(1) A method for specifying a copying machine used to record a document in accordance with an output hard copy from the color copying machine.

The foregoing method has a structure such that a small yellow dot pattern is recorded on the output hard copy. The dot pattern has a shape peculiar to the condition of the copying machine, such as the model number. The output hard copy is read by a scanner or the like and then the superimpose-recorded dot pattern is extracted and subjected to a predetermined signal process so as to specify the copying machine.

(2) A method in which additional information is superimposed on a color image as a high frequency color difference synthesized image, The foregoing method has a structure such that additional information is encoded and a color difference component having a high spatial frequency peak corresponding to the code is superimpose-recorded on the original image. Since the color difference component having the high spatial frequency cannot easily be recognized by a human being, superimpose-recorded additional information does not substantially deteriorate the original image. Since a usual original image does not substantially have the high frequency color difference component, superimpose-recorded additional information can be reproduced by reading the recorded image and extracting the high frequency color difference component by a signal process.

(3) A method in which additional information can be reproduced only when predetermined two images are overlapped.

The foregoing method is arranged to perform pseudo level representation of an image such that two images having different level representations in specific regions are produced and the specific regions appear dark when the two images have been overlapped.

However, the foregoing methods (1) and (2) must perform complicated operations in addition to the signal process for reading the image in order to reproduce the superimpose-recorded additional information. Therefore, superimpose-recorded additional information cannot easily be reproduced. The foregoing method (3) involves a pair of two images being overlapped. If the images forming the pair are not overlapped, additional information cannot be reproduced. That is, if additional information is required to be reproduced from a plurality of images, there arises a problem in that images must be prepared to correspond to the number of the images.

BRIEF SUMMARY OF THE INVENTION

Accordingly, it is an object of the present invention to provide an image recorded product, an image recording system, an image reproducing system, and a recording medium capable of reproducing superimpose-recorded non-visible additional information from an image recorded as a hard copy in such a manner that the additional information can visually and easily be recognized only by using a universal optical device.

According to a first aspect of the present invention, there is provided an image recorded product having information items recorded thereon, the information items comprising at least any one of visible characters, symbols and numerals; and an image for certification formed by superimposing, on an original image, an additional image which is the same as the at least any one of characters, symbols and numerals or which has the relationship with the same, the additional image being impossible to be visually recognized and permitted to be visible when a universal optical filter is used.

According to a second aspect of the present invention, there is provided an image recording system comprising means for superimposing, on an original image, an additional image which is the same as at least any one of characters, symbols and numerals or which has the relationship with the same recorded on a product; and means for recording an image obtainable from the superimposing means on the product as an image for certification, the additional image being impossible to be visually recognized and permitted to be visible when a universal optical filter is used.

According to a third aspect of the present invention, there is provided an image reproducing system comprising a universal optical filter for visualizing a non-visible additional image for an original image from an image for certification, which is a hard copy formed by superimposing the non-visible additional image on the original image and is recorded on a product, wherein the additional image is the same as at least any one of visible characters, symbols and numerals recorded on the product or has the relationship with the same.

According to a fourth aspect of the present invention, there is provided a recording medium having computer program code instructions stored thereon which perform image recording when executed by a computer system, the instructions comprising superimposing an additional image which is the same as the at least any one of visible characters, symbols and numerals recorded on a product or which has the relationship with the same; and recording the superimposed image on the product as an image for certification, the additional image superimpose-recorded on the product being impossible to be visually recognized and being permitted to be visible when a universal optical filter is used.

Additional objects and advantages of the present invention will be set forth in the description which follows, and in part will be obvious from the description, or may be learned by practice of the present invention. The objects and advantages of the present invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the present invention and, together with the general description given above and the detailed description of the preferred embodiments given below, serve to explain the principles of the present invention in which:

FIGS. 20A to 20E are diagrams showing kernels for a smoothing filter for smoothing an original image according to the fifth embodiment;

FIG. 27 is a diagram showing the pattern structure of a reproducing sheet shown in FIG. 26;

FIGS. 28A to 28C are diagrams showing frequency spectrum of an image obtained by superimposing the reproducing sheet on a recorded product according to the fifth embodiment;

FIG. 36 is a diagram showing the structure of a lenticular lens which is a reproducing optical device in the shape of a sheet according to the eighth embodiment;

FIG. 37 is a diagram showing a principle of reproducing a additional image according to the eighth embodiment of the present invention;

FIG. 38 is a diagram showing a reproducing state in a case where the phase of the reproducing optical device and that of the pattern image in the synthesized image on the recorded product are shifted; and FIG. 39 is a table for use to obtain distribution coefficient of errors.

DETAILED DESCRIPTION OF THE INVENTION

Figure 1:
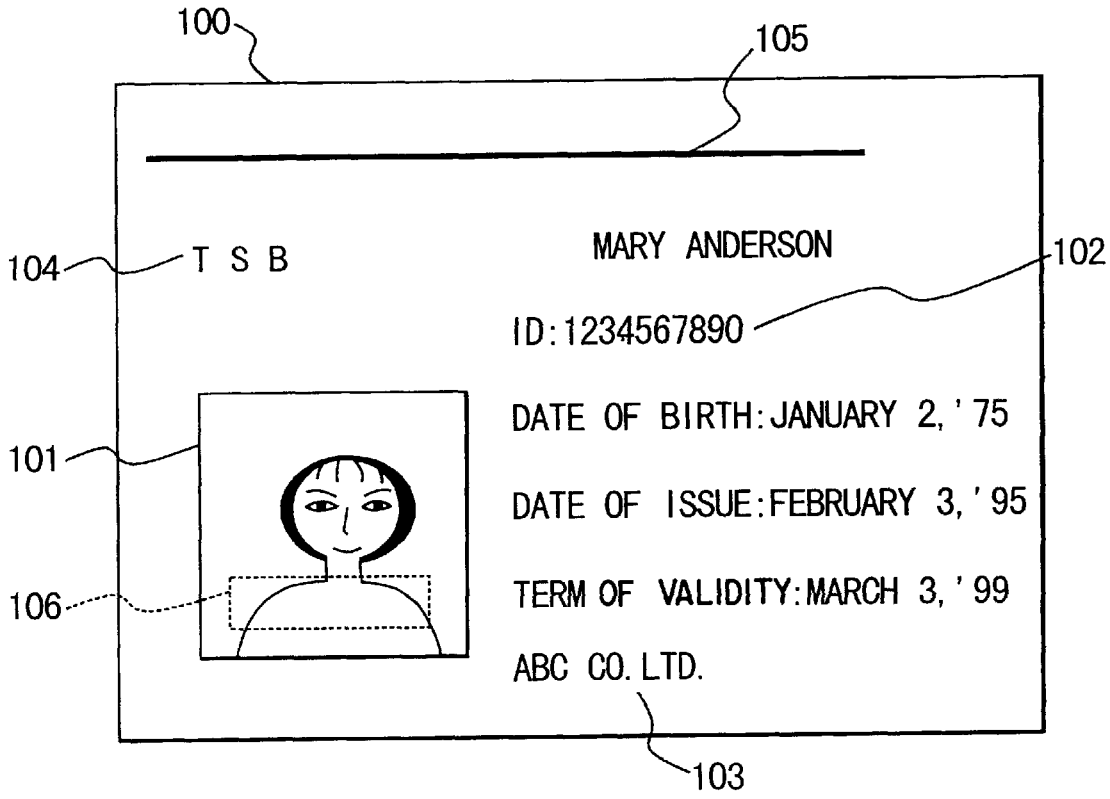
FIG. 1 is a diagram showing an ID card serving as a recorded product according to a first embodiment of the present invention.

Prior to describing embodiments of the present invention, the basic concept of the present invention will now be described in order to cause the present invention to be understood easily.

According to the present invention, the pattern of an original image is modulated to superimpose and record additional information on the original image. In this case, a pattern image, such as a color difference lattice pattern in the form in which values of gains to be given to a predetermined quantity of color difference are, for each pixel, arranged to have a predetermined pattern and having a high spatial frequency, is superimposed and recorded on an original image. As a result, superimpose-recorded additional information cannot substantially visually be recognized. Moreover, the quality of the image required to be certificated does not deteriorate. When a universal optical device (a sheet-like or a lens type filter) having a transmittance distribution or a thickness distribution corresponding to a predetermined image pattern is superimposed on the thus-obtained recording product, additional information can be visualized. Thus, additional information can easily be reproduced without a necessity of performing a complicated signal process in such a manner that additional information above can visually be recognized.

Referring to the drawings, embodiments of the present invention will now be described.

<First Embodiment>

FIG. 1 is a diagram showing an example of an ID card serving as a recorded product according to this embodiment. The ID card 100 has a face picture portion 101 of an owner in the form of an ink image printed thereon. Moreover, information, such as an ID number 102 peculiar to the owner, a publisher name 103 and a logotype 104 of the publisher, is recorded. In addition, a stripe-shape magnetically recorded portion 105 is formed. Moreover, an additional-information recording region 106 is formed in a portion of the face picture portion 101 as indicated by a dashed line. The additional-information recording region 106 has the same mark as the logotype 104 and code information of the ID number 102, for example, as a pattern (an image) which cannot visually be recognized and which can be recognized through a reproducing filter to be described later, the mark and code information being superimpose-recorded on the face picture portion 101. Hereinafter, the logotype and code information recorded on the additional-information recording region 106 will be given generic name as additional information.

Figure 2:
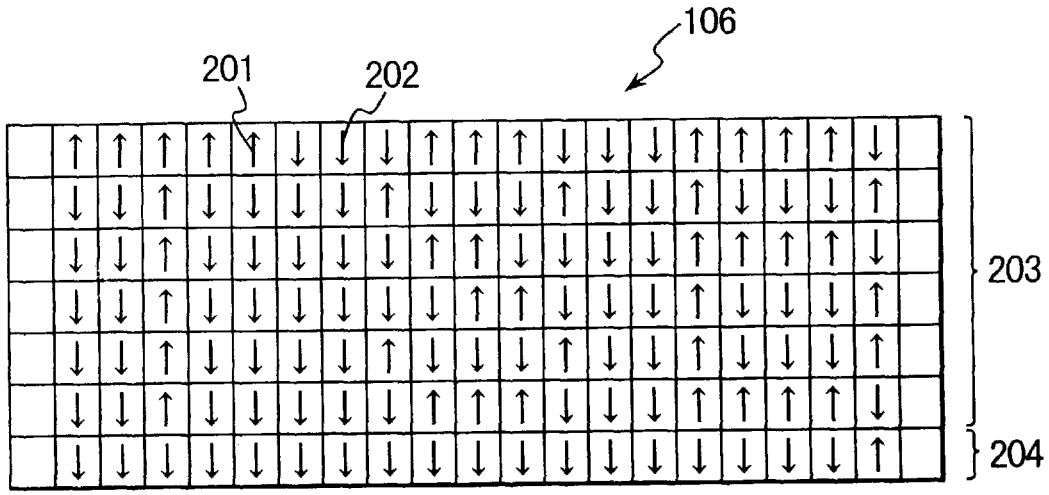
FIG. 2 is a schematic view showing an additional image recording region shown in FIG. 1.

FIG. 2 is a schematic view showing details of the pattern of additional information recorded on the additional-information recording region 106. As shown in FIG. 2, the additional-information recording region 106 is composed of a color difference lattice pattern consisting of two types of lattices, that is, first lattices 201 indicated by upward arrows and second lattices 202 indicated by downward arrows. The additional-information recording region 106 is composed of a logotype recording portion 203 and a code-information recording portion 204. The logotype recording portion 203 composed of six upper lines has characters/symbols, which are characters "TSB" in this embodiment, formed by the first lattices 201 on the second lattices 202 as a background.

The code-information recording portion 204 which is the lowest line in the additional-information recording region 106 has code information in the form, in which the ID number is subjected to a signature process in binary notation by a known public key cryptosystem, code information above being recorded in the form of a color difference lattice pattern. Note color difference above will be described later. Although the code-information recording portion 204 is formed by one line in the case shown in FIG. 2, it may be composed of several lines because the quantity of data increases if the signature process is performed.

Figure 3A:
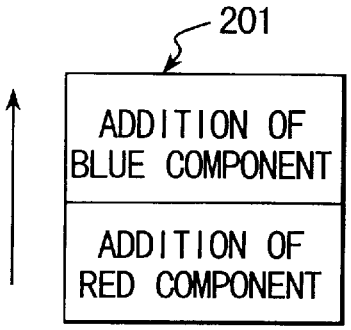
FIGS. 3A and 3B are enlarged views showing two lattices shown in FIG. 2.
Figure 3B:
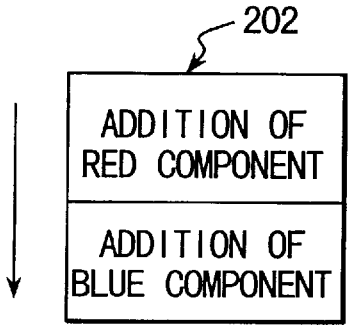

FIGS. 3A and 3B are diagrams showing details of the first lattice 201 and the second lattice 202. The first lattice 201 shown in FIG. 3A has an upper half portion including a blue component which is added to (emphasized in) the face picture portion 101 so that a red component is correspondently reduced in order to prevent change in the luminosity. Conversely, a lower half portion includes a red component which is added to the face picture portion 101 so that the blue component is correspondently reduced in order to prevent change in the luminosity. The second lattice 202 shown in FIG. 3B has a converse structure to that of the first lattice 201 such that an upper half portion includes a red component which is added to the face picture portion 101 so that a blue component is correspondently reduced in order to prevent change in the luminosity. Conversely, a lower half portion includes a blue component which is added to the face picture portion 101 so that the red component is correspondently reduced in order to prevent change in the luminosity. The first and second lattices 201 and 202 are called color difference lattice pattern.

That is, assuming that ink for forming the face picture portion 101 is cyan, magenta and yellow and ink quantity signals for instructing the quantity of each ink is Co (cyan), Mo (magenta) and Yo (yellow), the color difference lattice pattern is, in the first and second lattices 201 and 202, is modulated because $\pm\alpha c$, $\pm\alpha m$ and $\pm\alpha y$ respectively are added in accordance with additional information as expressed in Equation (1):

$$C'=Co\pm\alpha c$$

$$M'=Mo\pm\alpha m$$

$$Y'=Yo\pm\alpha y \quad (1)$$

However, it is desirable that addition of $\pm\alpha c$, $\pm\alpha m$ and $\pm\alpha y$ does not change luminosity $I=(\pm\alpha c)+(\pm\alpha m)+(\pm\alpha y)$ and change only the color difference. The first lattices 201 and the second lattices 202 are structured such that they have the same chromaticity, that is, the color difference between the first lattices 201 and the second lattices 202 is substantially zero.

Sign ± provided for $\alpha c$, $\alpha m$ and $\alpha y$ is selected in accordance with additional information to be recorded. As described above, the color difference lattice pattern is modulated with additional information. The thus-modulated color difference lattice pattern is added to original ink quantity signals Co, Mo and Yo. Ink quantity signals C', M' and Y' obtained by the addition are supplied to a color printer so that the image of the face picture is recorded on the face picture portion 101. Simultaneously, additional information is superimpose-recorded on the additional-information recording region 106 in the face picture portion 101.

Assuming that one lattice has size of 4 dots×4 dots in a case where a color printer having a resolution of, for example, 600 dpi is used to record the face picture portion 101 and the additional-information recording region 106, one lattice is composed of 150×150 lines for each inch, which is substantially the same roughness as that realized in an image formed by usual half-tone printing. Therefore, if additional information in the additional-information recording region 106 is superimposed on the face picture portion 101 in such a manner that the luminosity in the lattice is not changed or change can be reduced and the color difference between the first and second lattices 201 and 202 is substantially zero, the lattices in the additional-information recording region 106 and the logotype and the ID number, which are additional information items, cannot substantially visually be recognized.

Figure 4:
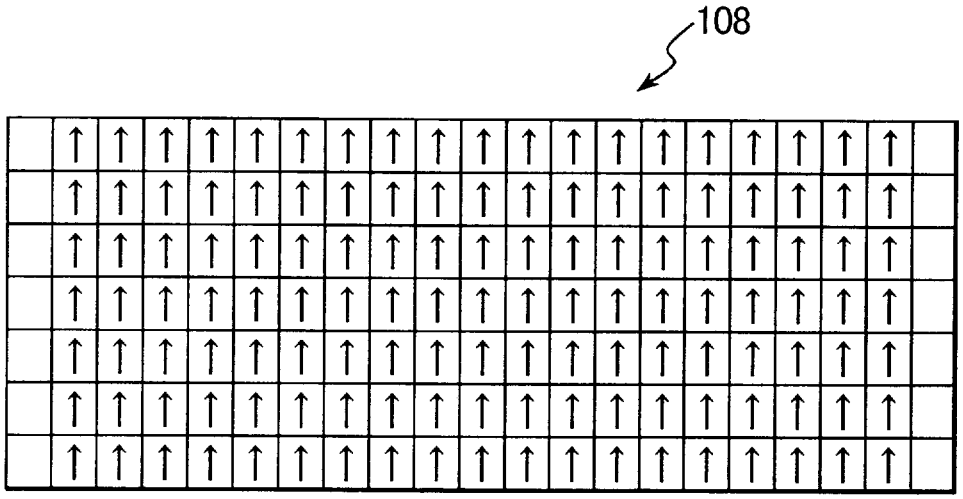
FIG. 4 is a schematic view showing a reproducing filter according to the first embodiment.

As described above, the contents recorded in the additional-information recording region 106 cannot visually be recognized. When the reproducing filter 108 structured as shown in FIG. 4 is superimposed, the contents can visually be recognized. The reproducing filter 108 shown in FIG. 4 has a structure similar to that of the first lattice 201 shown in FIG. 3A such that the upper half portion is formed by a color difference lattice filter having an upper half portion in which the flue filter lattices are arranged in a :matrix configuration and a lower half portion in which the red filter lattices are arranged in a matrix configuration.

When the reproducing filter 108 is superimposed on the additional-information recording region 106, the structure in which the character portion of the logotype recording portion 203 is composed of the first lattices 201 causes the flue filter to be superimposed on the portion in which the blue component has been added and the red filter to be superimposed on the portion in which the red component has been added. Thus, luminosity realized by twice superimposing blue and red is obtained. On the other hand, the background portion of the logotype recording portion 203, composed of the second lattices 202, is made such that the red filter is superimposed on the portion in which the blue component has been added and the blue filter is superimposed on the portion in which the red component has been added. Thus, the background is made to be darker than the character portion.

Figure 5:
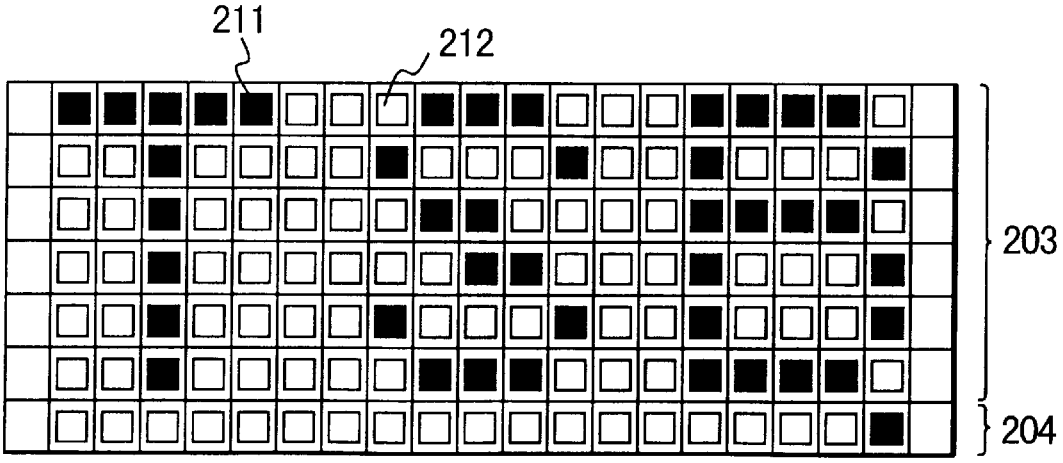
FIG. 5 is a diagram showing a state where a logotype recorded in the additional information recording region is reproduced by the reproducing filter according to the first embodiment.

As a result, as shown in FIG. 5 showing a state where the reproducing filter 108 is superimposed on the additional-information recording region 106, logotype characters "TSB" can visually be recognized. That is, the character portions 211 are brightened and the background portions 212 are darkened so that the characters of the logotype are visually recognized. Although the widths of lines forming the lattices and widths of lines forming the characters are substantially the same in the example shown in FIG. 5, the widths of the characters and code information are considerably larger than those of the lattices. Therefore, size with which the logotype can easily be recognized is realized in actual.

As an alternative to the color difference lattice filter having color difference lattices similar to the first lattices 201 shown in FIG. 3A and serving as the reproducing filter 108, another lattice filter may be employed which is composed of lattices similar to the second lattices 202 shown in FIG. 3B, that is, color difference lattices, the upper half portion of each of which is made of a red filter and th e lower half portion of each of which is made of a blue filter. In this case, the character portions 211 shown in FIG. 5 are conversely darkened and the background portions 212 are brightened. Thus, the logotype can visually be recognized also in this case.

As the reproducing filter 108, a lattice filter may be employed in which white and black lattices are arranged in a matrix configuration, the white and black lattice having a transparent upper half portion and a lower half portion composed of a black lattice. When the foregoing reproducing filter is employed, only the upper half upper half portion of the lattice penetrates the reproducing filter in the additional-information recording region 106. Thus, a portion, to which the blue component has been added, is recognized in the character portion 211, while a portion, to which the red component has been added, is recognized in the background portion 212. Therefore, bluish characters of the logotype appears on a reddish background. When rough characters forming a logotype or the like are reproduced, the character can clearly be recognized when the white and black lattice filter is employed as the reproducing filter. That is, since the color difference is easily recognized as compared with the density because of the characteristic of the visibility of the human being when the pattern has a low filter, a structure in which the pattern on the additional-information recording region 106 is converted into color difference information by the white and black filter and the pattern is reproduced enables the pattern to easily be recognized.

Although one lattice is divided into two vertical sections, each of the upper half portion and the lower half portion may be formed into a square matrix shape.

As described above, the ID card 100 according to this embodiment has the structure such that the same mark as the logotype 104 is superimpose-recorded in the additional-information recording region 106 on the face picture portion 101 as a pattern which cannot visually be recognized by a usual method and which can visually be recognized when the reproducing filter 108 composed of a specific color difference lattice filter is used. Therefore, forgery can effectively be prevented. That is, information on the ID card 100 shown in FIG. 1, such as the face picture portion 101, the ID number 102, the publisher name 103, the logotype 104 and so forth can relatively easily be reproduced by a third party, that is, a forger of the card by using a precise color scanner, a color printer and a personal computer or the like. However, information, which has been superimpose-recorded on the face picture portion 101 and which cannot visually be recognized, cannot easily be reproduced by a third party who does not know the structure.

Therefore, by using the reproducing filter 108 to confirm the contents recorded in the face picture portion 101, a forged ID card can easily be detected because the ID card has no information at the position corresponding to the additional-information recording region 106 or the ID card has recorded information (information except the logotype and the ID number) which has not been intended by the publisher.

This embodiment has the structure such that code information is, in the code-information recording portion 204 in the additional-information recording region 106, recorded in the form of the binary notation obtained by subjecting the ID number to the signature process performed by the public key cryptosystem. Therefore, forgery can substantially be prevented. Even a logotype recorded in the logotype recording portion 203 in the additional-information recording region 106 and a logotype recorded by a random pattern and error diffusion recording system, to be described later, can be forged in principle by performing considerable quantity of analysis which enables the recorded logotype having a pattern, which cannot easily visually be recognized, to be detected. Therefore, code information having signature of the publisher of the ID card is, individually from the logotype recorded in the logotype recording portion 203, recorded in the code-information recording portion 204 by using the signature technology of the public key cryptosystem. Thus, the public key allows a window for treating the ID card 100 or the user to verify that the ID card 100 has not been forged.

Code information subjected to the signature process is recorded to the code-information recording portion 204 is performed by, for example, the following method: assumption is performed that the ID number of a person having the ID card 100 is a, the public key of the publisher of the ID card is (e, n) and a secret key is d. The publisher subjects ID number a to the signature process with secret key d, that is, encodes the ID number a. Code information b after the signature process has been performed is expressed by the following Equation (2):

$$b=a^d(\text{mod } n) \tag{2}$$

where (mod n) is a remainder operation of n and b is a remainder obtained by dividing $a^d$ with n. Code information above is converted into the form of the color difference, that is the pattern of the first lattices 201 shown in FIG. 3A or that of the second lattices 202 shown in FIG. 3B so as to be written on the code-information recording portion 204 shown in FIG. 2.

When the ID card 100 is verified, the logotype recorded in the logotype recording portion 203 is recognized and code information b is visually recognized by bringing the reproducing filter 108 shown in FIG. 4 into close contact with the ID card 100.

Whether or not forgery has been performed is verified in accordance with code information b after the signature process has been performed as follows: for example, a window which has received the ID card 100 uses the public key (e, n) made public by the card publisher to perform and remainder operation as $b^e$ (mod n). If the original ID number a of the owner of the card can be obtained as a result of the foregoing operation, a fact can be verified that the ID card is not a forgery. As described above, whether or not the ID card is a forgery can be verified by only the public key and the secret key is required to be stored by only the publisher. Therefore, leakage can be prevented and operation can be performed significantly safely. The foregoing signature technology has been considered that decoding cannot be performed even with an astronomical amount of calculations and thus the foregoing technology is a considerably safe method.

As described above, code information obtained by subjecting the ID number to the signature process by the known signature technology is recorded in the code-information recording portion 204 in the additional-information recording region 106 in the face picture portion 101. Thus, forgery of the ID card 100 can substantially be prevented. For example, in a case where a forger obtains an ID card of another person by a some method, analyzes the recorded pattern and the method of recording the logotype in the logotype recording portion 203, writes the logotype on the face picture of the forger in a non-visible form and thus a forged ID card (a card having new name and new ID number) is made, forgery cannot be performed if the code information b subjected to the signature process cannot be obtained.

If the ID number recorded in the code-information recording portion 204 can be dead-copied though the possibility of this considerably low, forgery can be performed. Accordingly, a method may be employed in which the characteristic of the face (whether the face —is a round face or a long face) is signed and written together with the ID number. If the characteristic of the body or the like is different from the written information, dead copy and forgery can be detected. If other information items, for example, zip code, date of issue and/or date of birth, are combined with the ID number, code information b subjected to the signature process cannot easily be obtained. Thus, forgery can be prevented further reliably.

In order to further reliably prevent forgery, another method may be employed in which a public key of the publisher of the card is used to encode and write a registered confirmation number (similar to a password) of each user; the window side uses a secret key secretly supplied from the publisher of the card to decode the encoded confirmation number and then requires the owner of the ID card to present the confirmation number to confirm the confirmation numbers. By recording the pair of the ID number and the confirmation number in the code-information recording portion 204 shown in FIG. 2, forgery by means of dead copy cannot be performed.

The logotype recorded in the logotype recording portion 203 can be confirmed visually by superimposing the reproducing filter 108 on the ID card 100 as =described above. Also information recorded in the code-information recording portion 204 in a state where information above cannot visually be recognized is converted into code information b subjected to the signature process when the reproducing filter 108 is superimposed on the ID card 100. Whether or not code information b subjected to the signature process is correct can be confirmed by the power and remainder operation as $b^e$ (mod n) as described above. The power and remainder operation can easily be performed by an exclusive one-chip LSI available at present. Therefore, the exclusive LSI is included in, for example, an exclusive calculator, such as a pocket calculator, to perform calculations after code information subjected to the signature process has been visually confirmed so as to confirm the obtained ID number. Thus, whether or not the ID card is a forgery can easily be checked. As described later, code information b recorded in the code-information recording portion 204 may optically be read so as to perform power and remainder operation of code information b to display information above.

The contents to be recorded in the additional-information recording region 106 shown in FIG. 1 are not limited to the logotype and the ID number. For example, a figure pattern, such as a simple, circle mark, may be recorded. When the reproducing filter 108 is used to reproduce additional information, the simple pattern can easily be recognized.

An image recording system for recording information in the face picture portion 101 and the additional-information recording region 106 of the ID card 100 according to this embodiment will now be described.

Figure 6:
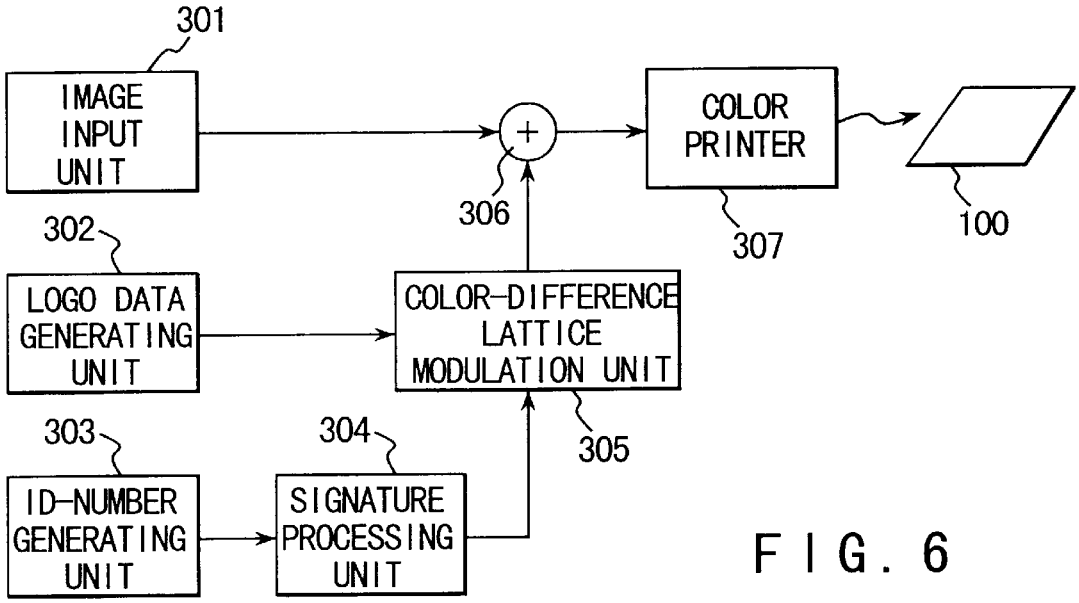
FIG. 6 is a block diagram showing the structure of an image recording system according to the first embodiment.

FIG. 6 is a block diagram showing the structure of the image recording system. An image input unit 301 comprises, for example, a color scanner. Information, to be recorded, that is, the face picture of an owner of the ID card 100 is read ad an image into the face picture portion 101 of the ID card 100 to output Co (cyan), Mo (magenta) and Yo (yellow) ink quantity signals. A logotype data generating unit 302 generates image data (logotype data) of the logotype 104. An ID-number generating unit 303 generates binary code information of the ID number 102. Logotype data generated by the logotype data generating unit 302 is directly supplied to a color difference lattice modulation unit 305, while code information of the ID number supplied from the ID-number generating unit 303 is, as described above, subjected to the signature process in a signature processing unit 304 and then supplied to a color difference lattice modulation unit 305.

The color difference lattice modulation unit 305 modulates the color difference lattice pattern in accordance with logotype data and code information of the ID number subjected to the signature process to convert the color difference lattice pattern into $\pm\alpha c$, $\pm\alpha m$ and $\pm\alpha y$ signals. An adder 306 adds the $\pm\alpha c$, $\pm\alpha m$ and $\pm\alpha y$ signals supplied from the color difference lattice modulation unit 305 and the ink quantity signals Co, Mo and Yo supplied from the image input unit 301 so as to generate ink quantity signals C', M' and Y' expressed by Equation (1) and output the signals to a color printer 307. As a result, the face picture portion 101 and the additional-information recording region 106 of the ID card 100 can be recorded.

Figure 7:
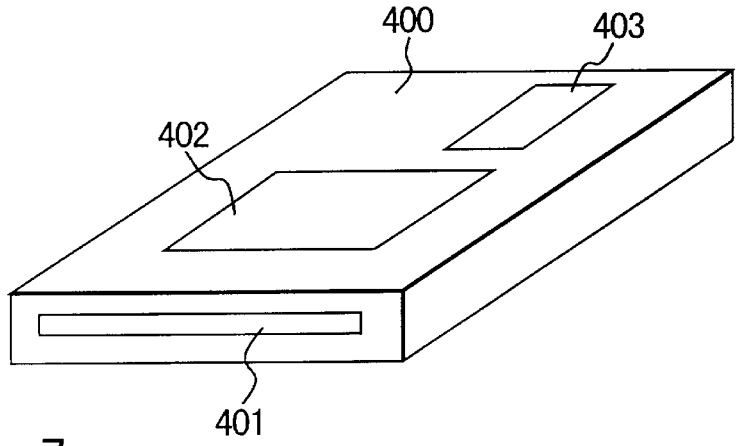
FIG. 7 is a diagram showing the shape of a card reader as an image reproducing system according to the first embodiment.
Figure 8:
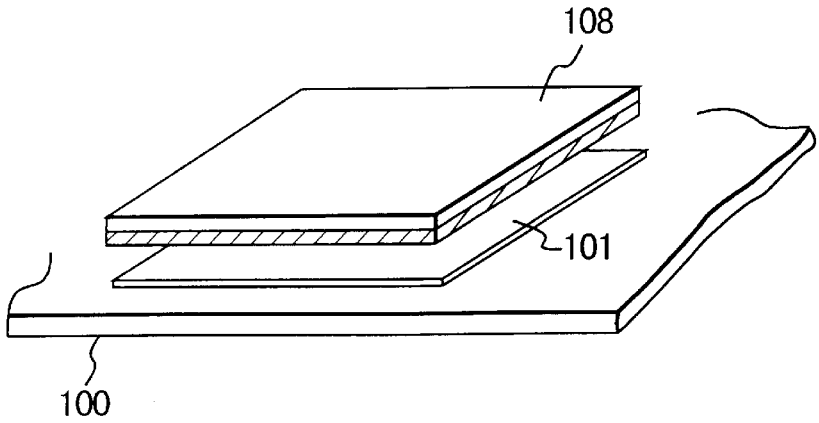
FIG. 8 is a diagram showing a state where the reproducing filter is superimposed on the ID card.

Referring to FIG. 7, an embodiment of a card reader as an image reproducing system for reading information on the ID card 100 to reproduce read information will now be described. When the ID card 100 is inserted into a card insertion opening 401 of the card reader 400, the reproducing filter 108 as shown in FIG. 4 is superimposed on the face picture portion 101 of the ID card 100, as shown in FIG. 8. The logotype on the logotype recording portion 203 in the additional-information recording region 106 is, through the reproducing filter 108, can visually be recognized through a visual-confirmation window 402 formed in the surface of the body of the ID card 100. It is desirable that a simple illumination device be added to enable the logotype to be recognized even in a dark state, such as at night.

When the reproducing filter 108 is superimposed on the ID card 100 to reproduce information, the gap between the face picture portion 101 of the ID card 100 and the reproducing filter 108 is required to be shortened to reproduce information with satisfactory contrast. It is desirable that the surface on which the lattices of the reproducing filter 108 have been patterned and the surface of the face picture portion 101 are in close contact with each other as shown in FIG. 8. Specifically, it is desirable that the gap from the face picture portion 101 of the ID card 100 to the reproducing filter 108 be not longer than the pitch of the lattices (about 160 $\mu$m). If the reproducing filter 108 is in the form of a simple color difference lattice pattern as shown in FIG. 4, the structure in which the face picture portion 101 and the surface of the reproducing filter 108 are made to be opposite to each other does not arise any problem. If a random lattice pattern to be described later is employed, the face picture portion 101 and the surface of the reproducing filter 108 disposed to be opposite to each other sometimes arises a fact that the right and left portions are inverted. In this case, the pattern of the reproducing filter 108 is required to be made opposite to invert the right and the left.

The card reader 400 has a display unit 403, such as a liquid crystal display unit. The display unit 403, as described later, read code information on the code-information recording portion 204 in the additional-information recording region 106 and displays a result of the verification of the ID number obtained by the power and remainder operation. If the confirmation number to be displayed is provided, the display unit 403 displays the confirmation number. If the characteristic of the body synthesized with the ID number and subjected to the signature process is provided, the characteristic is displayed. The user of the card reader 400 can confirm whether or not the owner of the ID card 100 is the original owner in accordance with the display above and confirm whether or not the ID card is a forgery.

Figure 9:
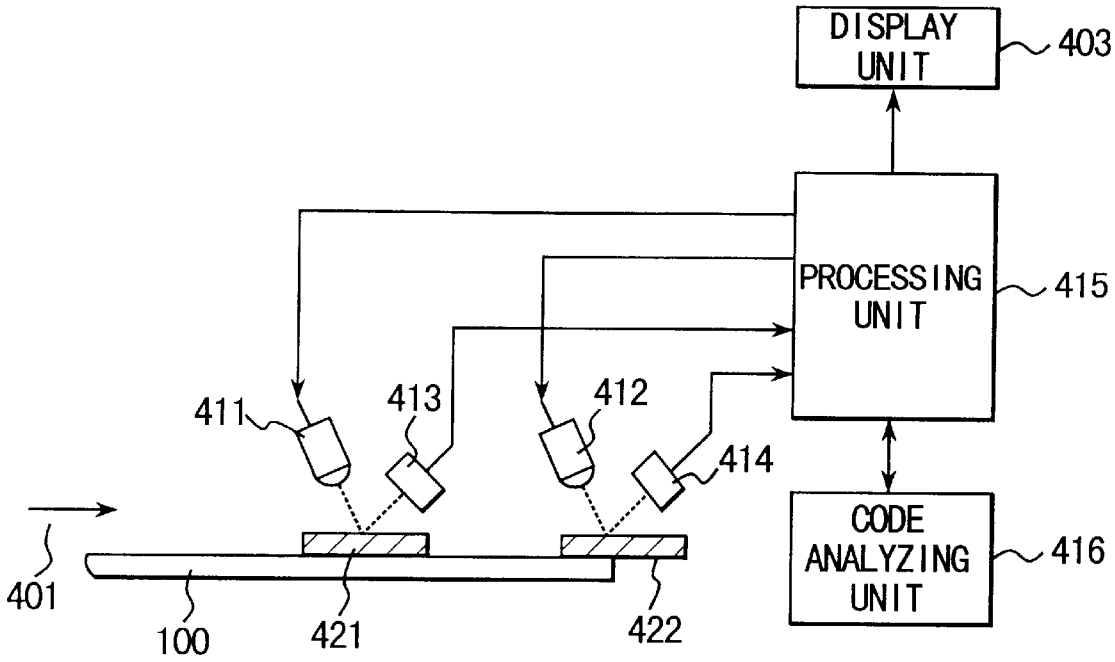
FIG. 9 is a diagram showing the structure of an identification mechanism in a code information recording section of the card reader according to the first embodiment.

An identifying unit of the card reader 400 for identifying code information on the code-information recording portion 204 will now be described with reference to FIGS. 9, 10A and 10B. Referring to FIG. 9, when the ID card 100 has been inserted into the card insertion opening 401 of the card reader 400 in a direction indicated by an arrow, the code-information recording portion 204 is illuminated by red LED 411 and 412. Reflected light from the code-information recording portion 204 is detected by optical sensors 413 and 414. At this time, masks 421 and 422 for selecting the first lattices 201 or the second lattices 202 shown in FIGS. 3A and 3B are brought into close contact with the upper surface of the ID card 100 as illustrated.

Figure 10A:
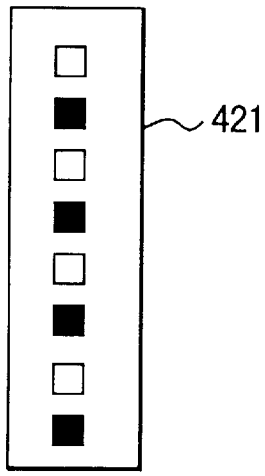
FIGS. 10A and 10B are diagrams showing the structures of two masks shown in FIG. 9.
Figure 10B:
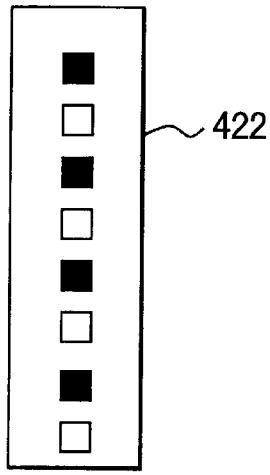

FIGS. 10A and 10B specifically show the masks 421 and 422. A pattern relieved in white indicates a transparent portion and a solid black portion indicates a light shielding portion. Although the structures of the masks 421 and 422 shown in FIGS. 10A and 10B are formed to have four lines of transparent portions and light shielding portions. The foregoing structures correspond to the structure in which the code-information recording portion 204 is formed by four lines of lattice patterns consisting of the first lattices 201 or the second lattices 202 shown in FIGS. 3A and 3B. When the code-information recording portion 204 is allowed to pass under the mask 421 shown in FIG. 10A, the upper half portions of the first lattices 201 and 202 shown in FIGS. 3A and 3B are selectively illuminated and read. When the code-information recording portion 204 is allowed to pass under the mask 422, the lower half portions of the first and second lattices 201 and 202 are selectively illuminated and read.

A case will now be considered in which the pattern of the first lattice 201 shown in FIG. 3A of the code-information recording portion 204, that is, the blue/red pattern portion in which blue is added to the upper half portion and red is added to the lower half portion is read. Initially, the blue pattern is illuminated with red light through the mask 421 for selecting the upper half portion, and the optical sensor 413 reads information. Thus, the output from the optical sensor 413 is made to be a small value. Then, the red pattern of the blue/red pattern is illuminated with red light through the mask 422 for selecting the lower half portion so as to be read by the optical sensor 414. Thus, the output from the optical sensor 414 is made to be a large value.

A case will now be considered in which the pattern of the lattice 202 shown in FIG. 3B of the code-information recording portion 204, that is, the red/blue pattern in which red is added to the upper half portion and blue is added to the lower half portion is read. Initially, the red pattern is illuminated with red light through the mask 421 for selecting the upper half portion so as to be read by the optical sensor 413. Therefore, the output from the optical sensor 413 is made to be a large value. Then, the blue pattern of the red/blue pattern is illuminated with red light through the mask 422 for selecting the lower half portion so as to be read by the optical sensor 414. Therefore, the output from the optical sensor 414 is made to be a small value.

Therefore, comparison between the outputs from the optical sensors 413 and 414 by a processing unit 415 enables determination whether the pattern of the code-information recording portion 204 to be read is the blue/red pattern shown in FIG. 3A or red/blue pattern shown in FIG. 3B to be performed. As described above, code information b of the ID number subjected to the signature process on the code-information recording portion 204 can be read. The processing unit 415 supplied thus read code information b to a code analyzing unit 416 comprising an LSI for only RSA (one of the public key cryptosystems). The code analyzing unit 416 verifies the signature code, restores the confirmation code and reproduces the characteristic of the body and the like, and then returns results to the processing unit 415. The processing unit 415 supplies the results to the display unit 403 to be displayed.

As described above, this embodiment enables code information b subjected to the signature process and in the form converted into the precise color difference lattice pattern to be read without use of a precise sensor to determine whether or not the ID card 100 is a forgery. Note that a precise color sensor may be employed read code information b to detect the color difference between the upper half portion and the lower half portion of the lattice so as to verify code information b similarly to the foregoing structure.

<Second Embodiment>

Figure 11:
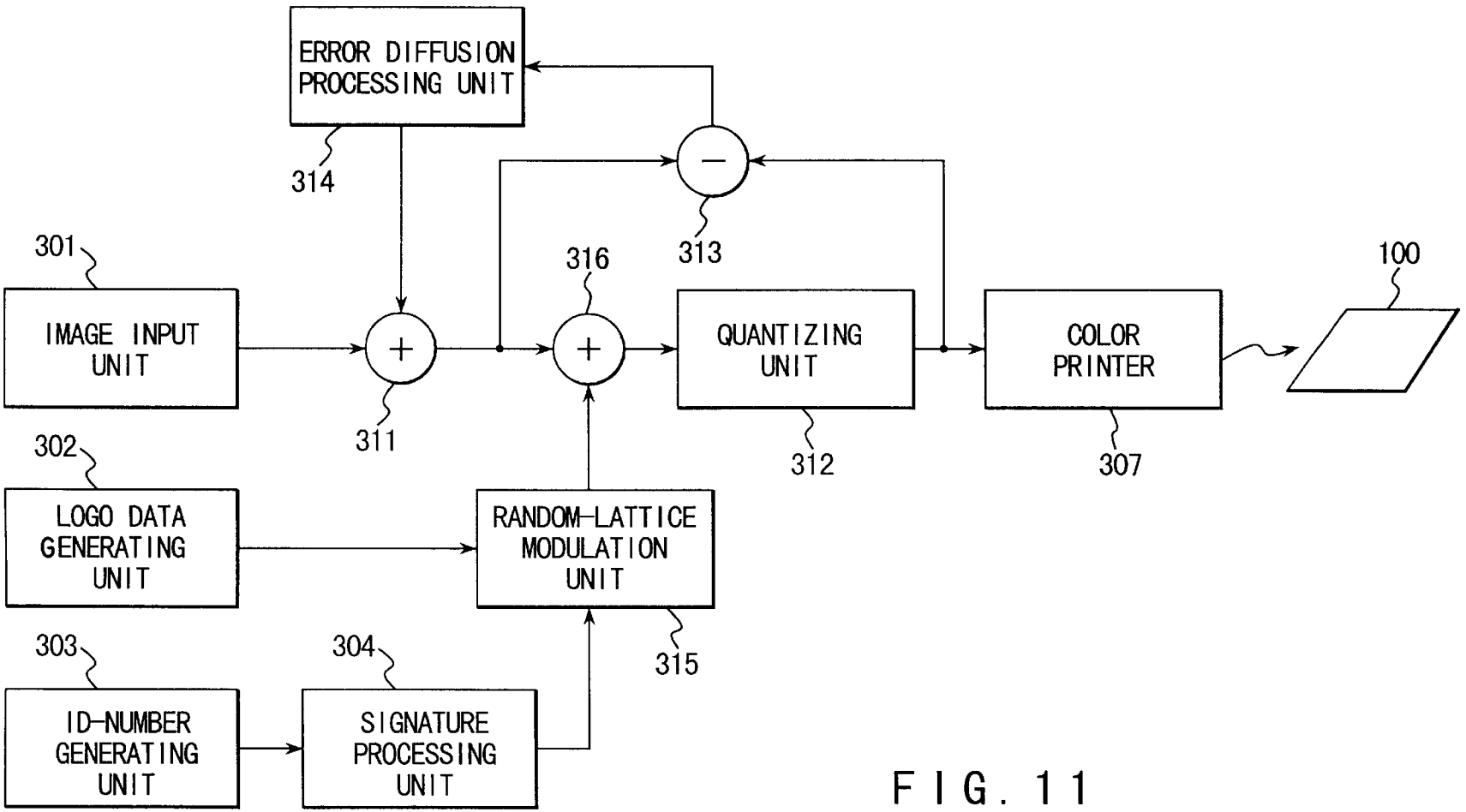
FIG. 11 is a block diagram showing the structure of an image recording system according to a second embodiment.

FIG. 11 is a block diagram showing the structure of an image recording system according to a second embodiment. Referring to FIG. 11, the same elements as those shown in FIG. 6 are given the same reference numerals. This embodiment is structured such that the error diffusion recording system and the random lattice modulation are combined with each other to make extremely difficult to examine the structure of the reproducing filter by using the synergistic effect of the random pattern and error diffusion recording pattern in order to further make difficult forgery.

Referring to FIG. 11, ink quantity signals, which have supplied from the image input unit 301 and which are information items of the face picture portion 101, are supplied to an error diffusion recording system comprising an adder 311, a quantizing unit 313, a subtractor 313, an error diffusion processing unit 314 and a color printer 307. On the other hand, logotype data supplied from the logotype data generating unit 302 is directly supplied to a random lattice modulation unit 315, while code information supplied from the ID- number generating unit 303 is, similarly to the foregoing embodiment, subjected to the signature process in the signature processing unit 304, and then supplied to the random lattice modulation unit 315.

The random lattice modulation unit 315 modulates the random lattice pattern in accordance with logotype data and code information of the ID number subjected to the signature process. Specifically, for example, M- series code is used to generate pseudo-random lattice information, and information is generated which is obtained by modulating the random lattice with a red component emphasizing signal and a blue component emphasizing signal to correspond to the upper and lower patterns similarly to the case of the regular lattice.

A random lattice modulation signal obtained by the random lattice modulation unit 315 as described above is, by an adder 316, added to an image signal of the face picture, to which an error diffusion signal has been added by the adder 311. Then, the added signal is quantized by the quantizing unit 313 to correspond to a multi-value output enable number of the color printer 307, and then supplied to the color printer 307. If the color printer 307 is a binary-image printer, the quantizing unit 313 performs binary quantization. In view of the visual characteristic of a human being, quantization to be a quadruple value or greater with a resolution of 600 dpi or a hexadecimal value or greater with a resolution of 300 dpi is performed by the quantizing unit 313 to obtain a satisfactory image. An error signal between the signal supplied to the color printer 307 and an output signal from the adder 311 is obtained by the subtractor 313. The error signal is supplied to the known error diffusion processing unit 314 comprising a line memory, a diffusion coefficient table and a multiplier so that an error diffusion signal is generated. The error diffusion signal is, in the adder 311 added to an image signal of the face picture supplied from the image input unit 301.

As described above, according to this embodiment, logotype data and code information of the ID number subjected to the signature process are, in the random lattice modulation unit 315, used to modulate the random lattice pattern, and then subjected a pseudo level representation process in a error diffusion recording loop so that the image is recorded by the color printer 307. The error diffusion system obtains the error as the difference between a signal obtained by adding an error to an image signal of the face picture and a signal which is supplied to the color printer 307. In order to minimize the error, the error diffusion loops acts. That is, the main component (adjacent to the DC component) of the recorded signal approximates the image of the face picture.

On the other hand, logotype data and code information of the ID number modulated with the random lattice added immediately before the quantization performed by the quantizing unit 313 are formed into recorded signals due to local response of the quantizing unit 313 so as to be recorded by the color printer 307. However, the DC component and the like are not recorded.

Additional information, such as the logotype data and code information of the ID number superimpose-recorded on the face picture portion 101, can be reproduced by superimposing a reproducing filter comprising a random lattice pattern which is the same as the random lattice pattern which is modulated with additional information, similarly to decoding of the signal obtained by demodulating the regular color difference lattice pattern with additional information. That is the reproducing filter is made of a random lattice pattern which is not demodulated with logotype data and code information, such as the ID number, in the random lattice modulation unit 315. In this case, it is desirable that the pattern of either of the face picture portion 101 or the reproducing filter be structured such that the right and left be inverted.

When subtraction is performed in the subtractor 313, a recorded signal obtained when a signal supplied to the color printer 307 has been actually recorded is estimated in place of the output signal from the background portion 212, and then the estimated recorded signal and the output signal from the adder 311 be subjected to subtraction so that recording can be performed with satisfactory reproducibility. In particular, if picture dots have bleeding and the signal supplied to the color printer 307 and the actual recorded signal are different from each other, the foregoing method is an effective recording method.

An effect of this embodiment will now be described. If the color difference lattice modulation unit 305 demodulates the regular lattice pattern with additional information as is performed in the first embodiment, there is a risk that the structure of the reproducing filter 108 can be detected only by examining the pattern of the recorded additional information if additional information (logotype data of code information of the ID number) superimpose-recorded on the additional-information recording region 106 of the face picture portion 101 is not random. That is, by examining the lattice point estimated to have slight change in additional information, there is a risk that the rule of the lattices forming the reproducing filter 108 can be detected. However, the structure of this embodiment formed such that the random color difference lattice pattern is modulated with additional information does not permit the rule of the lattices at positions at which additional information is changed considerable and which are actually required to be decoded even if the rule of the lattices at positions estimated to have slight change in additional information is detected by examining the foregoing lattices.

Moreover, inclusion of fluctuation component from the error diffusion which is a pseudo level representation process having the size similar to the size of the random lattice makes difficult the rule of the random lattice to be decoded even at the position at which change in additional information is reduced. Since fluctuation of the error diffusion also depend upon the image signal, the random lattice cannot easily be decoded even if a considerably large quantity of recording samples are obtained.

<Third Embodiment>

Figure 12:
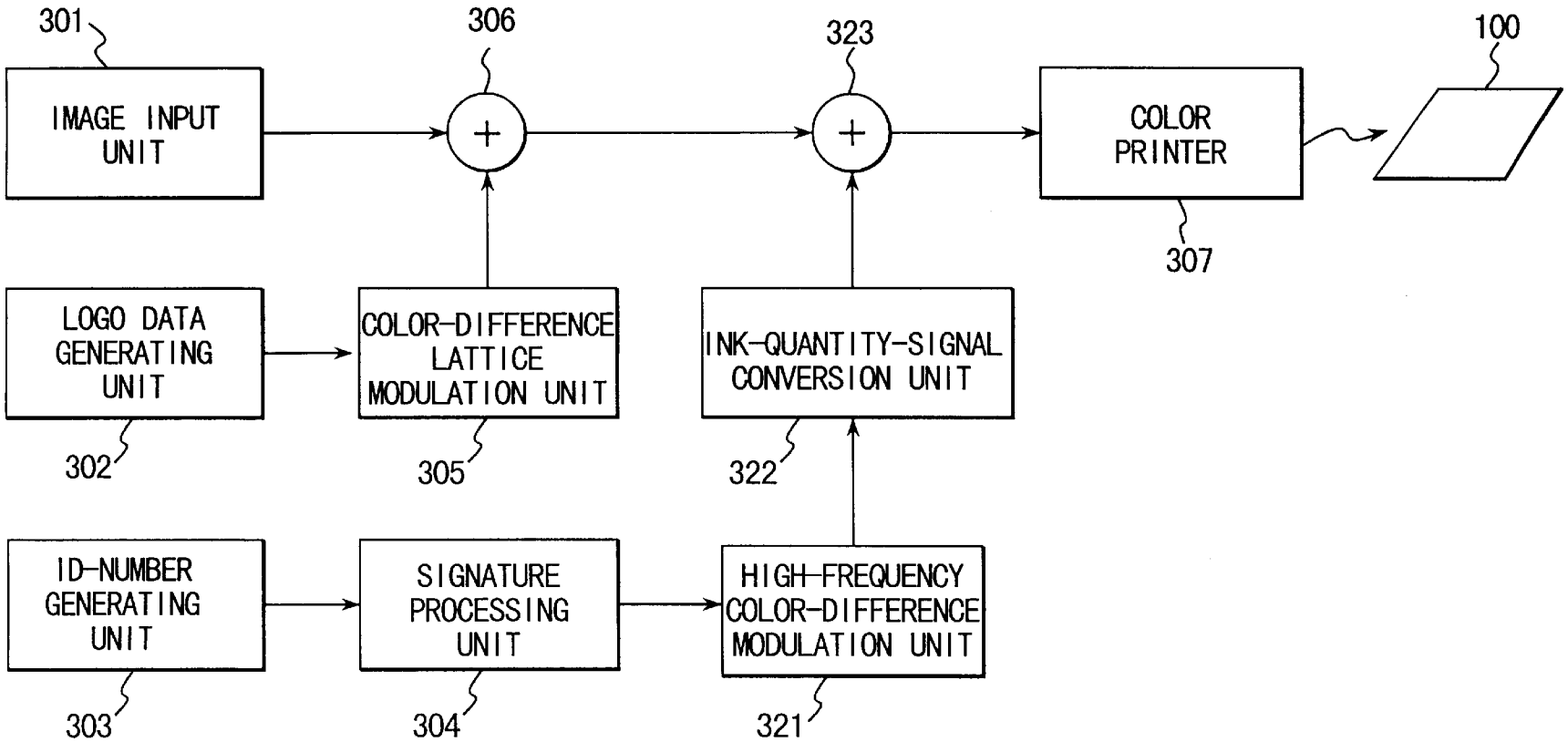
FIG. 12 is a block diagram showing the structure of an image recording system according to a third embodiment.

FIG. 12 is a block diagram showing the structure of an image recording system according to a third embodiment. In this embodiment, a method of converting additional information into a high-frequency color difference signal (for example, refer to Japanese Patent Application KOKAI Publication No. 7-123244) is employed to record additional information, in particularly, code information of the ID number, as a pattern which cannot visually be recognized. That is, the method according to this embodiment has the structure such that code information subjected to the signature process is, in the form which cannot visually be recognized, superimposed on the overall face picture in order to perfectly prevent forgery of the face picture.

Referring to FIG. 12, the same elements shown in FIG. 11 as those shown in FIG. 6 are given the same reference numerals. Logotype data supplied from the second lattices 202 is supplied to a color difference lattice modulation unit 305 so that the color difference lattice pattern is modulated similarly to the first embodiment. The modulated color difference lattice pattern is added to the image signal of the face picture in the adder 306. On the other hand, code information of the ID number supplied from the ID- number generating unit 303 is, in the signature processing unit 304, subjected to the signature process, and then supplied to the high-frequency color difference modulation unit 321.

The high-frequency color difference modulation unit 321 modulates a high-frequency color difference signal with code information of the ID number subjected to the signature process (at this time, a modulation method disclosed in, for example, Japanese Patent Application KOKAI Publication No. 7-123244 is employed). In this embodiment, a method of bit- disposing the high frequency color difference signal in a concentric code information is employed. The thus-modulated high frequency color difference signal is converted into an ink quantity signal by an ink quantity signal conversion unit 322, and then, in the adder 323, added to the ink quantity signal output from the adder 306 so as to be supplied to the color printer 307.

The high frequency color difference signal output from the high-frequency color difference modulation unit 321 is a weak signal which does not deteriorate the quality of the image of the face picture portion 101. Therefore, the image of the face picture portion 101 does not deteriorate in a macro view point, that is, no visual deterioration takes place. By using the characteristic that the high frequency color difference component is not substantially contained in a usual image, the high frequency color difference signal can be recorded even in a portion in which the image is considerably changed. However, the high frequency color difference signal cannot easily be recorded in a white portion, a black portion and solid color portions.

Accordingly, this embodiment has a structure such that code information of the ID number is, in the high-frequency color difference modulation unit 321, encoded in accordance with whether or not a multiple high frequency exist, that is, code information is recorded as signals of waves having the same contents over the image as is employed in hologram. Additional information is reproduced by a method in which high frequency color difference signals for a portion of the image are Fourier transform so that additional information is reproduced from a portion of the image.

Figure 13:
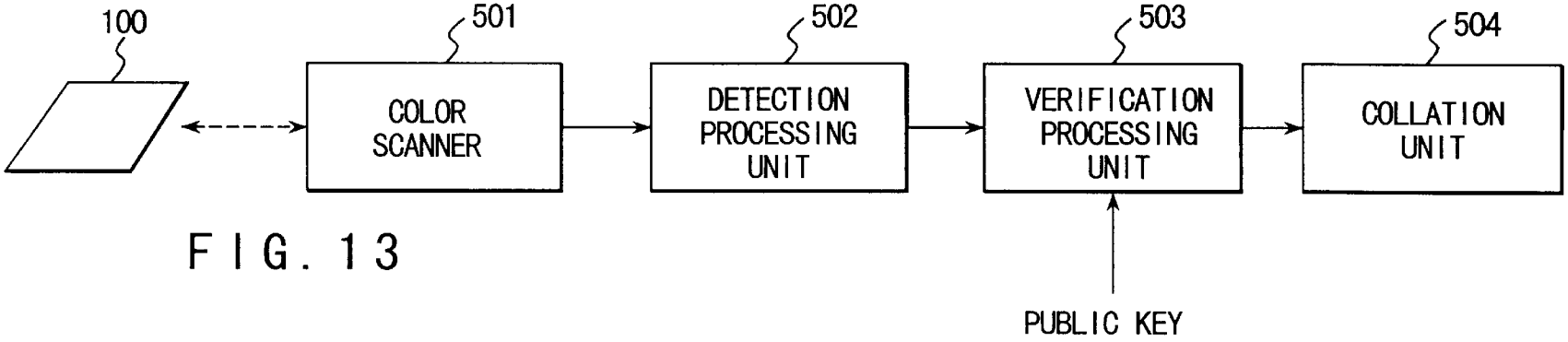
FIG. 13 is a block diagram showing the structure of an image recording system according to a third embodiment.

FIG. 13 is a block diagram showing the structure of an image reproducing system according to this embodiment. Information recorded in the face picture portion 101 on the ID card 100 by the image recording system shown in FIG. 12 is read by a color scanner 501 so that an image signal is output. That is, the high frequency color difference signal superimposed on the face picture portion 101 as additional information cannot be reproduced by only superimposing the reproducing filter on the ID card 100 in this embodiment as can be performed in the first embodiment. Therefore, the image of the face picture portion 101 is read by the color scanner 501 so as to be output as the image signal.

The image signal of the face picture portion 101 output from the color scanner 501 is supplied to a detection unit 502 so that the high frequency color difference signal is detected. Then, FFT (Fast Fourier Transformation) is performed to decode the image signal so that a bit signal, that is, code information of the ID number subjected to the signature process is reproduced. Code information subjected to the signature process is decoded by the verification processing unit 503 with a public key similarly to the foregoing embodiment, and then collating with the ID number written on the ID card 100, a reproduced signal from the magnetically recorded portion 105 attached to the ID number, a reading signal from the included IC if the ID card 100 includes the IC and a signal obtainable from a network. As a result of the collation above, no unlawful fact, such as forgery, can be confirmed.

As described above, this embodiment has the structure such that code information converted into the high frequency color difference signal and subjected to the signature process is superimposed on the overall surface of the face picture portion 101. Therefore, forgery of the ID card cannot significantly be performed by changing only the face picture if code information cannot be produced. Therefore, even an ID card including an IC, which cannot easily be forged and which is considered to be used widely in the future, is adapted to the face picture as the most effective means to identify that the user is the proper person. Therefore, this embodiment provides a significantly effect countermeasure against forgery by changing the photograph.

<Modification of First to Third Embodiments>

The first to third embodiments have the structure such that the ID number 102, in the form which can visually be recognized, is written on the ID card 100. A user at the window verifies code information b recorded on the additional-information recording region 106 and subjected to the signature process with a public key, that is, coincidence with the ID number 102 written on the ID card 100 is confirmed. The necessity of the confirmation by checking coincidence with information written on the ID card 100 can be eliminated. For example, secret information is recorded on the magnetically recorded portion 105 so that coincidence with information above is examined. Thus, the degree of secret can be improved and handling can be facilitated. Specifically, prevention by using the confirmation number is performed by checking coincidence with the confirmation number recorded in the magnetically recorded portion 105 in place of asking the owner. Thus, the window side is required to confirm that the face picture is similar to the owner of the ID card 100 to determine whether or not the ID card 100 is a forgery. On the other hand, a system has been investigated in which decision is made by circulation by electronic mail or the like as the network has been advanced. As a so-called electronic decision system, a system has been considered to be employed in which a password or like is used to permit only a specific person to signature and affix a seal.

Although a closed system is capable of maintaining security to a certain degree because passwords and seal impressions are managed. However, if a seal impression or the like is output as a hard copy, there arises a probability that the security cannot be maintained. As a matter of course, security of a closed system cannot be maintained by a malicious person skilled in the security system. In general, a system of the foregoing type is structured not to easily be modified without evidence.

If a seal impression or the like is output as a hard copy, a precise color scanner or a color printer is capable of forging the hard copy on the electronic decision system with substantially no evidence. This 6embodiment is structured to make difficult forgery of a document to be performed by illegally using the seal impression in the case where the foregoing hard copy is used.

Figure 14:
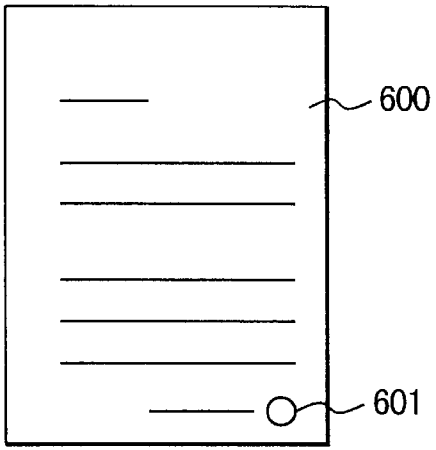
FIG. 14 is a diagram showing an example of a document having an impression and serving as a recorded product according to a fourth embodiment of the present invention.
Figure 15:
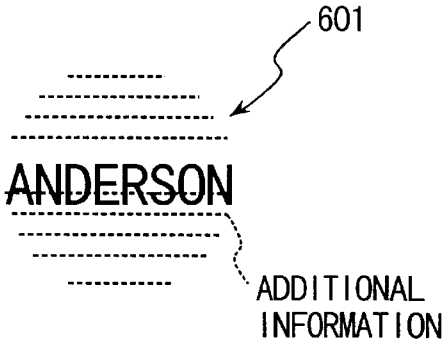
FIG. 15 is a diagram showing an impression and additional image superimposed on the impression by a monochrome printer according to the fourth embodiment.
Figure 16:
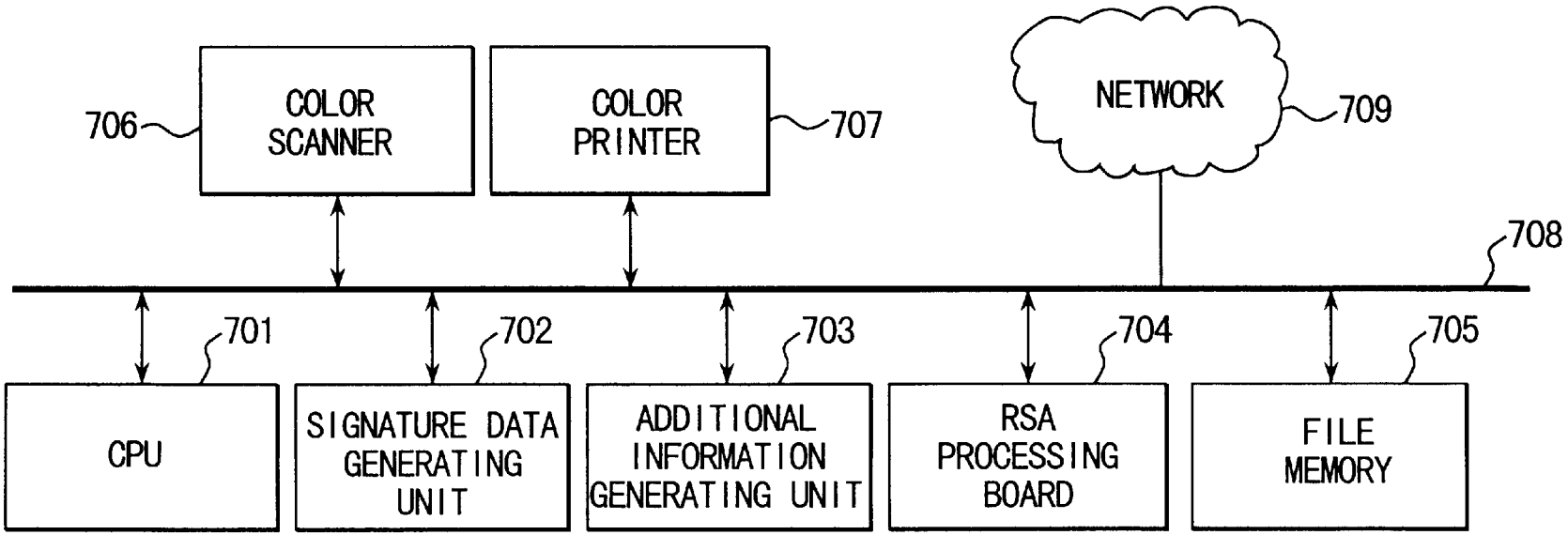
FIG. 16 is a block diagram showing the structure of an electronic decision making system using the impression according to the fourth embodiment.

FIG. 14 shows an example of a document 600 having a seal impression 601. FIG. 15 is an enlarged view of the impression 601. In this embodiment, the seal impression 601 is printed and recorded by an image recording system structured as shown in FIG. 16 to prevent falsification. The system shown in FIG. 16 has a structure such that a CPU 701, an impression data generating unit 702, an additional information recording unit 703, an RSA processing board 704, which is a code processing unit, a file memory 705, a color scanner 706 and a color printer 707 are connected to one another by a bus 708. The bus 708 is connected to a network, for example, a wireless network 709.

When the seal impression 601 is printed, guard of impression data is suspended to transfer impression data output from the impression data generating unit 702 to the color printer 707. Impression data is image data previously obtained by reading the actual seal impression by the color scanner 706. At this time, additional information including name of a person who has affixed the seal and date and time at which the seal was used is obtained from the additional information generating unit 703, and then subjected to the signature process in the RSA processing board 704. Then, additional information is superimposed on impression data output from the impression data generating unit 702, and then transferred to the color printer 707. If a checksum code or the like in the text on the document 600 is additionally signed as additional information, verification whether or not the text is falsified can easily be performed.

When additional information is superimposed on impression data, additional information is converted into a high frequency color difference signal similarly to, for example, the third embodiment. Thus, impression data is, in the form which cannot visually be recognized, is superimposed on overall impression data above. Although impression data and additional information are individually generated in the structure shown in FIG. 16, they may collectively be stored in the file memory 705. If the CPU 701 is a high speed processor, the signature process may be performed by the CPU 701 such that the exclusive RSA processing board 704 is not employed.

Thus, name of the owner, date and the checksum code of the text are provided for impression data, and then impression data is hard-copy output. Although the thus-obtained document is recognized as a usual document, additional information subjected to the signature process can be obtained by reading the data by the color scanner similarly to the foregoing embodiment, converted into a color difference signal by the CPU 701, and then subjected to the FET. Then, the RSA processing board 704 or the CPU 701 performs a verifying process of the additional information signal by using the public key similarly to the third embodiment so that a fact that the owner has signed and affixed the seal is confirmed. If the checksum code of the text is added, verification whether or not falsification has been performed can be performed in accordance with the code. Thus, security of even a document output from a closed electronic decision system as a hard copy can be maintained.

Security of documents of a type which must be decided with signatures of a plurality of decision making persons is maintained in a closed electronic decision system by a contrivance thereof. A system of a type using a hard copy in part may be structured as follows.

Referring to FIG. 16, the seal impression on the document is read by the color scanner, and then a verification is performed by the public key of the decision making person. If the document is a right document, a next decision making person makes a decision. Also in this case, a password is used to suspend the guard of impression data, and the signature process is performed by using additional information. Then, the document is supplied to the color printer 707 so as to be printed. If signed name or the like is added to additional information above, a further hierarchy stamping system can be realized and the safety of the security can be improved. As described above, even if the document is output as a hard copy during the process of the electronic decision system, security can be maintained.

Although the structure shown in FIG. 16 has the structure such that the color scanner 706 and the color printer 707 are employed, the present invention may be applied to a structure having a monochrome scanner and printer. For example, the structure shown in FIG. 15 is formed such that additional information 601 is superimpose-recorded on the seal impression 600. Additional information is encoded in the form of the length of the dot and the position of the dot and recorded on the background of seal impression "UNDERSON". Any method may be employed to encode additional information if the method permits information to easily be ready by a scanner. It is furthermore desirable that an error correction code be added to additional information above in order to improve reliability.

Although additional information is superimpose-recorded on the seal impression 600 in the foregoing embodiment, an original document having a background image, such as a pattern, may be recorded such that additional information is superimpose-recorded on the background image.

<Fifth Embodiment>

A fifth embodiment of the present invention will now be described.

An image synthesizing and recording system according to this embodiment is a system having a structure such that a synthesized image formed by superimposing additional information on an original image is recorded as a hard copy. In this case, the recorded synthesized image is recognized by a human being as an image similar to the original image and additional information cannot be recognized. Additional information above cannot visually be recognized if a special system or a method, to be described later, is not used.

Figure 17:
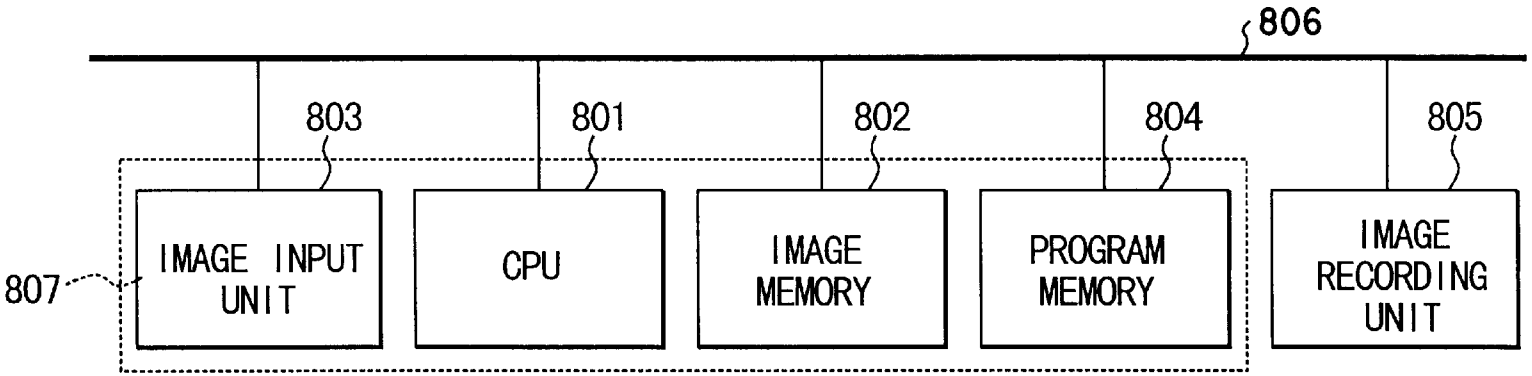
FIG. 17 is a block diagram showing the structure of an image synthesizing and recording/reproducing system according to a fifth embodiment.

FIG. 17 shows the structure of the image synthesizing and recording system according to this embodiment. The image synthesizing and recording system according to this embodiment has a CPU 801, an image memory 802, an image input unit 803, a program memory 804 and an image recording unit 805 which are connected to one another through a bus 806. The CPU 801, the image memory 802, the image input unit 803 and the program memory 804 form an image processing unit 807.

The operation of the image synthesizing and recording system according to this embodiment will be described briefly. Initially, an original image and additional information (an image of additional information) are written in predetermined regions in the image memory 802 through the image input unit 803. In accordance with the following algorithm, the foregoing images are subjected to a calculation process so that a synthesized image is produced. The synthesized image is recorded by the image recording unit 805 as a color hard copy.

The foregoing sequential process is performed by the CPU 801 in accordance with a program stored in the program memory 804. Although the process may be performed by using an exclusive system, a general-purpose computer, such as a personal computer, may be employed. In this case, the image memory 802 and the program memory 804 are usually obtained by dividing one memory.

The structure of the original image, which is the input image to the system according to this embodiment and contents and meaning of the image process will now be described.

The input image is, similarly to that for use in expression performed by a computer, expressed as digital information having the density defined on each lattice point in an orthogonal coordinate system. In this case, two axes of the orthogonal coordinate system are made to be x and y axes which are expressed as axis of abscissa and that of ordinates for convenience.

In this embodiment, additional image is a monochrome binary image such as a figure and characters. The density value of a pixel (x, y) is expressed as R(x, y). The original image is expressed as a full color image. Pixel value of R, G and B are expressed by Pr(x, y), Pg(x, y) and Pb(x, y). The pixel values expresses colors such that when Pr=0, Pg=0 and Pb=1, the pixel is black. When Pr=1, Pg=1 and Pb=1, the pixel is white.

The algorithm of the image process according to this embodiment will now be described. The flow of the process is shown in a flow chart shown in FIG. 18.

[First Step (Generation of Pattern)]

Initially, pattern image Q(x, y) is generated in first step S11. The pattern image is an image which is modulated with additional image so as to be superimposed on the original image. It is desirable that the pattern image be an image having a high spatial frequency which cannot easily be sensed by the eyes of the human being.

Figures 18, 19:
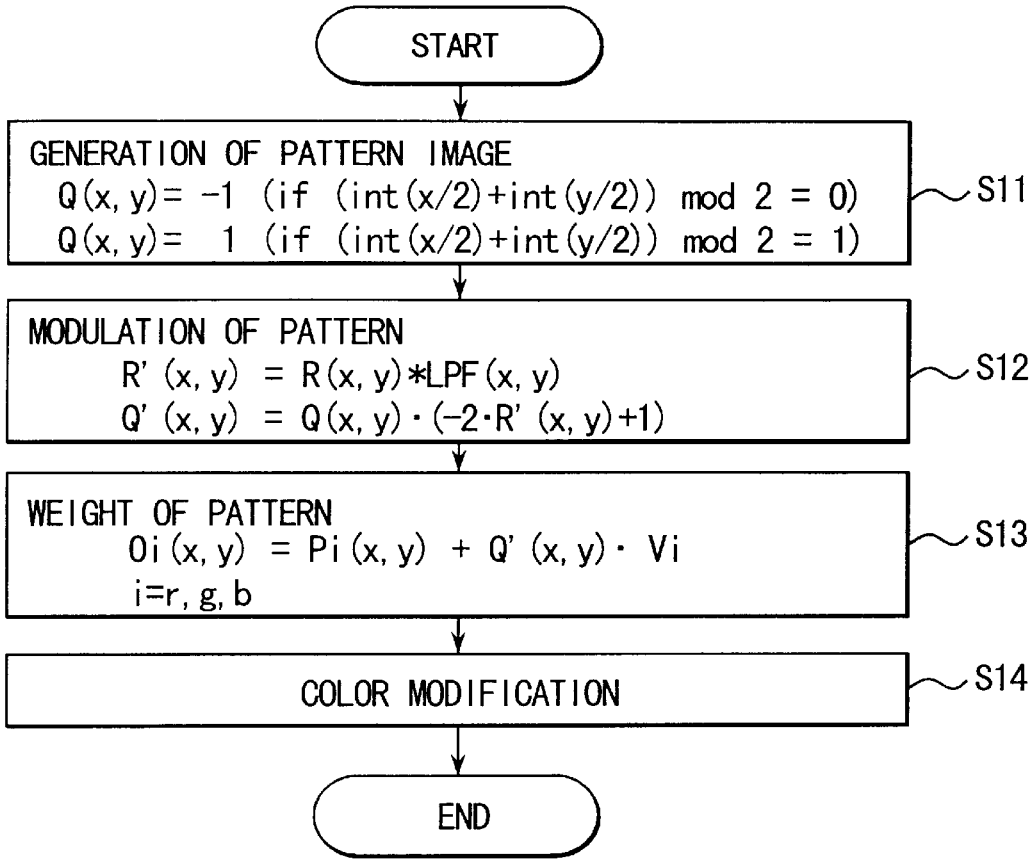
FIG. 18 is a flow chart showing the image processing procedure according to the fifth embodiment.
FIG. 19 is a diagram showing the structure of a dice-shape pattern image according to the fifth embodiment.

In this embodiment, a diced-pattern image as shown in FIG. 19 is employed as the pattern image Q(x, y). Each pixel of the pattern image Q(x, y) is expressed by a numeral 1 or −1. It physically means a gain for giving a predetermined quantity of color difference (Vr, Vg, Vb) for each pixel. A pattern image Q(x, y) of this type is called a color difference pattern image. The pattern image Q(x, y) shown in FIG. 19 is a pattern image having pixels having a gain of 1 and a gain of −1 and arranged in a diced pattern in units of (4×4) pixels. An equation for generating the pattern image Q(x, y) is as follows:

$$(\mathrm{int}(x/2)+\mathrm{int}(y/2))\mathrm{mod}2=0$$

$$\text{then } Q(x, y)=-1$$

$$(\mathrm{int}(x/2)+\mathrm{int}(y/2))\mathrm{mod}2=1$$

$$\text{then } Q(x, y)=1 \tag{3}$$

where int(x) is an operation for taking an integer portion of pixel and x mod y is an operation for expressing a remainder obtained when x is divided by y. The pattern image Q(x, y) is an image having a DC component is zero and a small low frequency component, that is, an image having a high spatial frequency.

[Second Step (Modulation of Pattern)]

In second step S12, additional image R(x, y) is used to modulate the pattern image Q(x, y). At this time, the additional image R(x, y) is processed by a smoothing filter in accordance with Equation (4) so that smoothed additional image R'(x, y) is obtained.

$$R'(x, y) = \sum_i R(x - xi, y - yi) \cdot A(xi, yi) \tag{4}$$

where xi, yi and Ai are kernels of the smoothing filter. In this embodiment, a smoothing filter having a kernel as shown in FIG. 20A and composed of (5×5) pixels. That is, $-2 \leqq xi, yi \leqq 2$ and A(xi, yi)=1/25.

By using smoothed additional image R'(x, y), the pattern image Q(x, y) is modulated in accordance with Equation (5) so that pattern modulated image Q'(x, y) is obtained.

$$Q'(x, y)=Q(x, y)\cdot(-2\cdot R'(x, y)+1) \tag{5}$$

As a result of the foregoing process, an image is, in a region satisfying R'=1, obtained as pattern modulated image Q'(x, y), the obtained image being −1 time the pattern image Q(x, y), that is, an image obtained by inverting the pattern image Q(x, y) is obtained. In a region satisfying R'=0, the pattern image Q(x, y) is the pattern modulated image. In a region where R' has a value between 1 and 0, the pattern modulated image Q'(x, y) has an intermediate value. Since R' is a smoothed signal, it has a value between 1 and 0 in the edge region of the additional image R(x, y). As a result of the foregoing process, the polarity of the amplitude is inverted in accordance with the pixel value of the additional image R(x, y). Thus, an image having an amplitude which is changed moderately is obtained in the edge portion as the pattern modulated image Q'(x, y).

Figure 21:
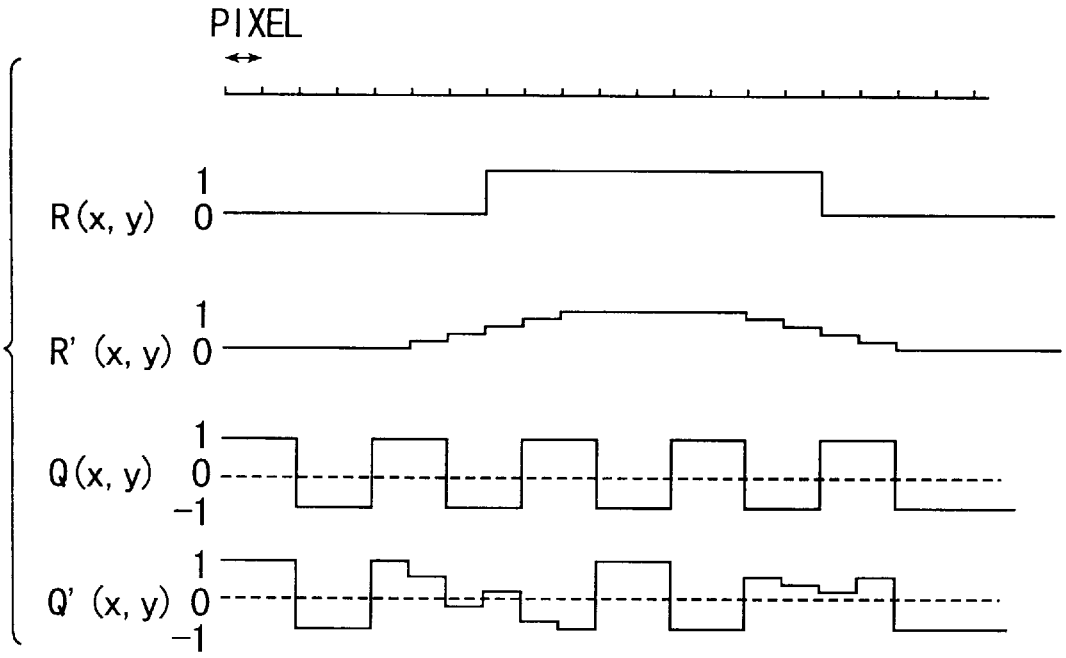
FIG. 21 is a diagram showing an example of the relationship among an additional image, smoothed additional image, a pattern image, and a pattern modulated image according to the fifth embodiment.

FIG. 21 shows the relationship among the additional image R(x, y), the smoothed additional image R'(x, y), the pattern image Q(x, y) and the pattern modulated image Q'(x, y). Note that the image is, in FIG. 21, expressed as one-dimensional image for convenience.

Although the foregoing description has been performed about the method in which the amplitude of the pattern image Q(x, y) is modulated with the smoothed additional image R'(x, y), phase modulation as expressed by Equation (6-1) may be employed as another example.

$$Q'(x, y)=Q(x+g(R'(x, y)), y) \tag{6-1}$$

where g(x) is a function having a value of 0 when x=0, a value of 3 when x=1, and a value of 1 when 0<x<1.

When the phase is modulated as described above, the pattern image Q(x, y) is shifted in the direction of the x axis by four pixels in the region satisfying R'=1. In the region satisfying R'=0, the pattern image Q(x, y) is made to be the pattern modulated image Q'(x, y). Since the pattern image Q(x, y) is a periodic image having a period of 4 pixels and symmetric with respect to the x axis, shifting by 4 pixels and −1 time of the amplitude have the same meaning. Therefore, a result of the phase modulation process and a result of the amplitude modulation process are the same in the regions where R' is 0 and 1. Only the edge portion of the additional image R(x, y) in which R' has the intermediate value is made to be different. The foregoing Phase modulation process attains an image having the phase which is moderately changed in the edge portion.

Figure 22:
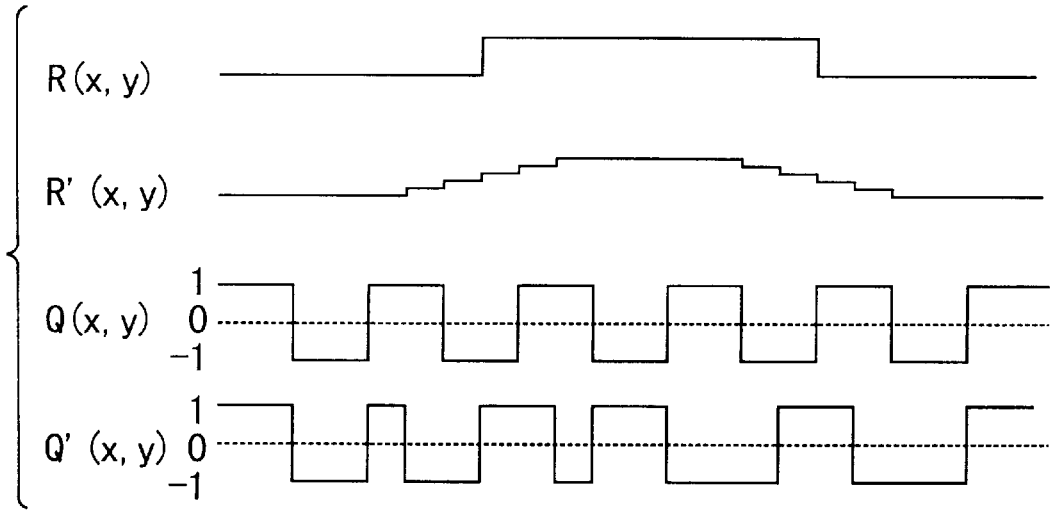
FIG. 22 is a diagram showing another example of the relationship among an additional image, smoothed additional image, a pattern image, and a pattern modulated image according to the fifth embodiment.

FIG. 22 shows the relationship among the Q'(x, y) is superimposed on the original image. In this embodiment, a simple addition operation is employed as the superimposing process. Since the pattern image Q(x, y) is a gain which is given to the color difference quantity (Vr, Vg, Vb) as described above, the original image is made to be Pi(x, y) (i=r, g, b) and the pattern modulated image Q'(x, y) is multiplied by the color difference quantity (Vr, Vg, Vb). Then, the original image is added to Pi(x, y). The color difference quantity (Vr, Vg, Vb) is set in such a manner that the luminosity is zero or substantially zero and the intensity is substantially lower than the limit of the visibility of a human being, for example, (Vr, Vg, Vb)=(0.1, 0.2, −0.4). The foregoing arrangement will be described later. If a result of the addition is larger than the defined range (0, 1) of the density level, it is clipped to the minimum value or the maximum value of the defined range.

The superimposing process, which is performed in step S13, is expressed in Equation (7). Note that the pattern superimposed image, which is a result of the superimposing process, is expressed as Qi(x, y) (i=r, g, b).

$$Or(x, y)=Pr(x, y)+Q'(x, y)\cdot Vr$$

$$Og(x, y)=Pg(x, y)+Q'(x, y)\cdot Vg$$

$$Ob(x, y)=Pb(x, y)+Q'(x, y)\cdot Vb$$

additional image R(x, y), the smoothed additional image R'(x, y), pattern image Q(x, y) and the pattern modulated image Q'(x, y) in a case where the phase modulation process is performed such that the images are expressed by one dimensional images similarly to the case shown in FIG. 21.

Although the phase modulation in the direction of the x axis has been described, the phase may be modulated in the direction of the y axis as expressed by Equation (6-2):

$$Q'(x, y)=Q(x, y+g(R'(x, y))) \tag{6-2}$$

Smoothing of the additional image R(x, y) is not limited to smoothing with a two dimensional reference region as shown in FIG. 20A, composed of (5×5) pixels and symmetrical vertically and laterally. For example, as shown in FIGS. 20B to 20D, the reference region may be a rectangular shape which is asymmetric vertically and laterally, or a one dimensional rectangular shape or a shape except the rectangle. A weighted smoothing as shown in FIG. 20E may be employed. When the foregoing process is performed by pipe line type hardware, the methods shown in FIGS. 20B and 20C with which the system can be formed by line memories having small capacities are employed to perform the smoothing process so as to reduce the cost of the circuit.

[Third Step (Superimposing of Pattern)]

In third step S13, the pattern modulated image $$\text{If } Or(x, y)\geqq 1, \text{ then } Or(x, y)=1$$

$$\text{If } Or(x, y)<0, \text{ then } Or(x, y)=0$$

$$\text{(Og and Ob have similar relationships.)} \tag{7}$$

[Fourth Step (Color Correction)]

In step S14 a pattern superimposed image Oi(x, y) expressed by RGB color components is converted into ink quantity signals Oc, Om and Oy for use to control the quantity of C, M and Y ink in the image recording unit 805. The foregoing conversion has been known as a color modification technology. In this case, the color modification process is performed in accordance with Equations (8-1) and (8-2). Matrices Acr, Acg, Acb, Amr, Amg, Amb, Ayr, Ayg and Ayb in Equation (8-1) are values depending upon the chromaticity of each ink for use in the image recording unit 805 and selected to be suitable for the image recording unit 805.

$$\begin{bmatrix} Dc \\ Dm \\ Dy \end{bmatrix} = \begin{vmatrix} Acr & Acg & Acb \\ Amr & Amg & Amb \\ Ayr & Ayg & Ayb \end{vmatrix} \cdot \begin{vmatrix} \log(Or) \\ \log(Og) \\ \log(Ob) \end{vmatrix} \tag{8-1}$$

$$\begin{aligned} Oc &= \exp(Dc) \\ Om &= \exp(Dm) \\ Oy &= \exp(Dy) \end{aligned} \tag{8-2}$$

If the process is performed by the YMC method, the process in the fourth step S14 can be omitted.

As described above, the image synthesizing process is performed sequentially in this embodiment. After the process has been performed, the image recording unit 805 records the color image as a hard copy in response to the ink quantity signals Oc, Om and Oy. As a result, a color image having substantially the same RGB components as the pattern superimposed images Or', Og' and Ob' is recorded on a predetermined recording medium (recording paper). As the image recording unit 805, for example, a sublimation type thermal transfer printer is employed. The sublimation type thermal transfer method enables to control the density of each pixel in 100 gradients and perform a full color recording operation.

The image recording unit 805 may be constructed using a silver salt photograph method. Another image recording system adapted to, for example, an ink jet recording method or a fusion type thermal transfer method suitable to perform binary-recording may be employed. When the binary recording printer is employed, a pseudo level representation process adapted to, for example, an error diffusion method or a systematic dither method, is required to be performed in order to express a gradient image. When the foregoing process is performed, image information having a high spatial frequency near the recording density of the printer is disordered or omitted. Therefore, an image recording system having a recording density sufficiently higher than the spatial frequency of the pattern image must be employed.

Although the foregoing sequential image synthesizing process has been realized by a software process, it can be realized by hardware.

Figure 23:
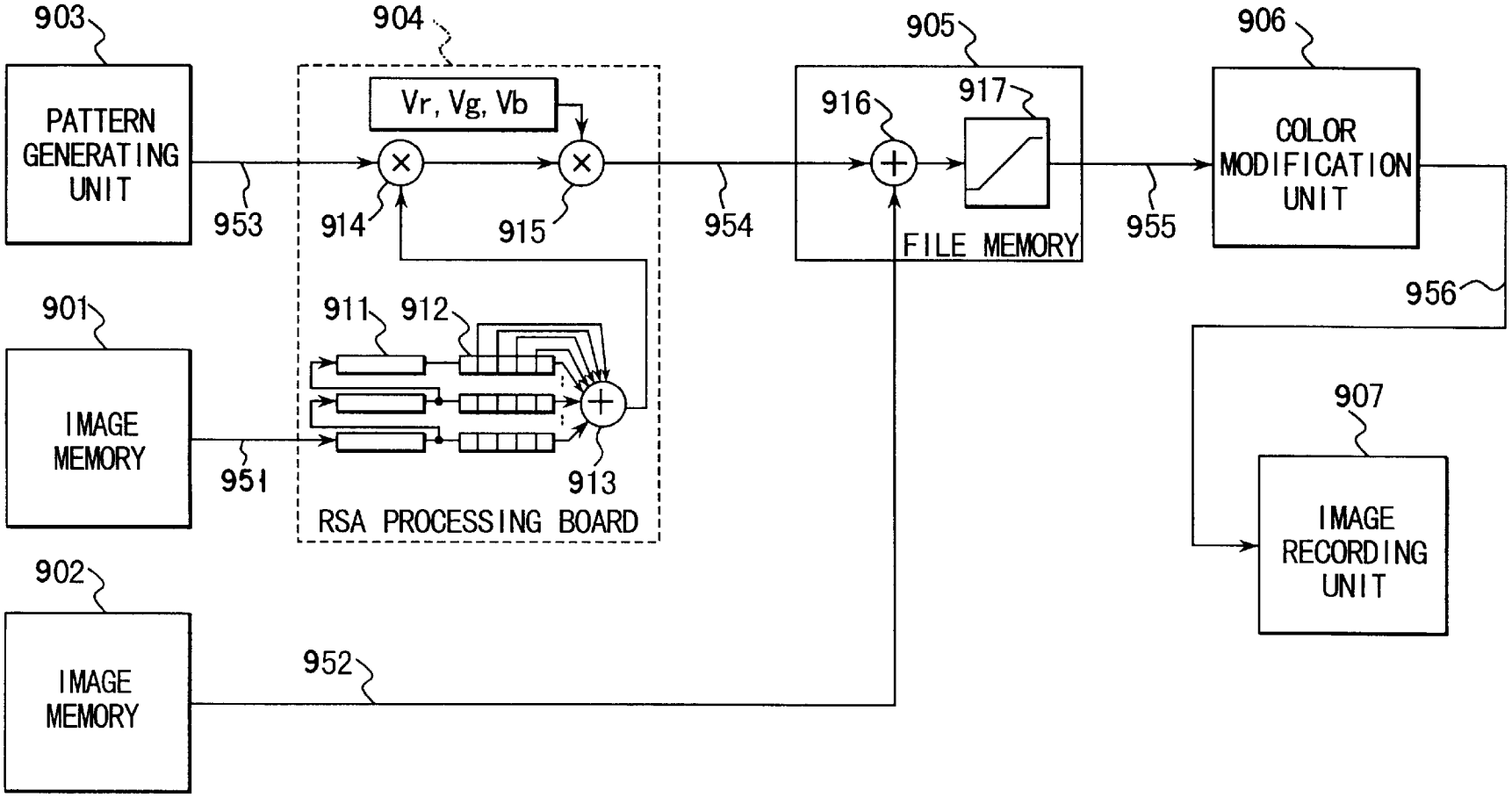
FIG. 23 is a block diagram showing an example in which an image processing system of the image synthesizing and recording system according to the fifth embodiment is realized by hardware.

FIG. 23 shows the structure of an image processing system of an image synthesizing and recording system for realizing the foregoing sequential image synthesizing process by hardware. The image processing system comprises two image memories 901 and 902 for storing an additional image and an original image, a pattern generating unit 903, a pattern modulation unit 904, a pattern superimposing unit 905, and a color modification unit 906. An image recording unit 907 is combined with the color modification unit 906 so that the foregoing image synthesizing and recording system is formed.

Initially, a pattern image signal, for example, a color difference pattern image signal 953 is generated by the pattern generating unit 903. In the pattern modulation unit 904, the color difference pattern image signal 953 is subjected to phase modulation in accordance with Equation (6-1) or (6-2) in response to an additional image signal 951 output from the first image memory 901 so that a pattern modulation image signal 954 is generated. Then, the pattern modulation image signal 954 is, in the pattern superimposing unit 905, superimposed on an original image signal 952 output from the second image memory 902 so that a pattern superimposed image signal 955 is generated. The pattern superimposed image signal 955 is, in the color modification unit 906, converted into an ink quantity signal 956 which is then supplied to an image recording unit 907 so that a hard copy image is output.

The operation of the image synthesizing and recording system will now be described further in detail. The first and second image memories 901 and 902 store the additional image R(x, y) and the original image P(x, y). The additional image R(x, y) stored in the first image memory 901 is a binary image which is expressed such that one pixel is expressed by one bit. The original image P(x, y) stored in the second image memory 902 is a full color image expressed such that each of R, G and B components is expressed by 8 bits. Thus, one pixel is expressed by 24 bits.

The pattern generating unit 903 generates a color difference pattern image signal 953. The pattern image is, as described above, a color difference pattern image signal which is generated in accordance with Equation (3).

The pattern modulation unit 904 comprises, for example, three line memories 911, a latch group 912 composed of 15 latches, an adder 913 and two multipliers 914 and 915. The additional image signal 951 output from the first image memory 901 is delayed by the line memories 911 and the latch group 912. Latch output from each of the latch group 912 is a signal in a rectangular region formed by (5×3) pixels. The latch outputs are added by the adder 913, and then supplied to the first multiplier 914 so that the color difference pattern image signal 953 is multiplied by the added latch outputs. Moreover, the second multiplier 915 multiplies the output from the first multiplier 914 denoting the result of the multiplying operation by a set of three parameters Vr, Vg and Vb. In this embodiment, one pixel signal is subjected to three times of multiplying operations. A result of the multiplying operation is, as the pattern modulation image signal 954 composed of time sequential RGB signals, output to the image recording unit 906.

The image recording unit 906 comprises the adder 916 and a clipping circuit 917. Initially, the adder 916 adds the original image signal 952 supplied from the second image memory 902 to the pattern modulation image signal 954 supplied from the pattern modulation unit 904. Since both of the pattern modulation image signal 954 and the original image signal 952 are RGB time sequential signals, the same components are added by the adder 916. A result of the addition operation performed by the adder 916 is clipped by the clipping circuit 917 so as to be output as the pattern superimposed image signal 955. That is, the clipping circuit 917 is operated to make the output to be 0 when the result of the addition is smaller than 0 and make the same to be 255 when the result is larger than 255.

The pattern superimposed image signal 955 output from the pattern superimposing unit 905 is a signal having the RGB components and arranged to be converted into an ink quantity signal 956 indicating the quantity of ink in the image recording unit 907. The image modification unit 906 is formed by, for example, a lookup table. The table is previously calculated in accordance with Equations (8-1) and (8-2) and stored in a memory.

As described above, the foregoing image synthesizing process can easily be realized. Since the signal process can be performed at relatively high speed if the hardware is employed, an advantage can be obtained in a case where a large number of sheets of images are produced in a short time.

The characteristic of the image (the pattern superimposed image) obtained by synthesizing the original image and the additional image recorded by the foregoing process will now be described. The synthesized image is an image which is visually recognized to be similar to the original image. Information of the additional image is information which cannot substantially be recognized.

Assuming that the RGB components of the original image are Pr(x, y), Pg(x, y) and Pb(x, y), the additional image is R(x, y) and the smoothed additional image is R'(x, y) (=R(x, y)·LPF(x, y)), RGB components OR(x, y), Og(x, y) and Ob(x, y) of the synthesized image are expressed by Equation (9).

$$Or(x, y) = Pr(x, y) + Q(x, y) \cdot Vr \cdot (-2 \cdot R'(x, y) + 1) \quad (9)$$

$$Og(x, y) = Pg(x, y) + Q(x, y) \cdot Vg \cdot (-2 \cdot R'(x, y) + 1)$$

$$Ob(x, y) = Pb(x, y) + Q(x, y) \cdot Vb \cdot (-2 \cdot R'(x, y) + 1)$$

Then, luminosity component Oy and color difference component Oc of the thus recorded synthesized image will now be described. The luminosity component Oy and color difference component Oc are defined by Equation (10).

$$Oy(x, y) = Kr \cdot Or(x, y) + Kg \cdot Og(x, y) + Kb \cdot Ob(x, y) \quad (10)$$

$$Oc(x, y) = Or(x, y) - Og(x, y)$$

where luminosity component Oy indicates the luminosity and the color difference component Oc indicates the intensity of the color. Although the color difference component Oc has two types of independent components, only one type of the component is treated. Note that (Kr, Kg and Kb) are coefficients respectively indicating the luminosity of the RGB components and having a value as (Kr, Kg, Kb) =(0.18, 0.81, 0.01).

The spectral Foy(fx, fy) and Foc(fx, fy) of the luminosity component Oy and the color difference component Oc are expressed by Equations (11-1) and (11-2).

$$Foy(fx, fy)=Fpy(fx, fy)+Vy \cdot Fq(fx, fy)*(-2 \cdot Fr'(fx, fy)+\delta(fx, fy)) \quad (11\text{-}1)$$

$$Foc(fx, fy)=Fpc(fx, fy)+Vc \cdot Fq(fx, fy)*(-2 \cdot Fr'(fx, fy)+\delta(fx, fy)) \quad (11\text{-}2)$$

where fx and fy respectively are spatial frequencies in the directions of x and y axes, Fr', Fq, Fpy and Fpc respectively are Fourier transform of the luminosity components and color difference components of the smoothed additional image R' and the pattern image Q and the original image P, and Vy and Vc are the luminosity component and the color difference component of the foregoing quantity of color difference.

Since the luminosity component Vy of the color difference quantity V is set to be zero or sufficiently approximates zero, the second term of Equation (11-1) is zero or substantially zero.

Figure 24B:
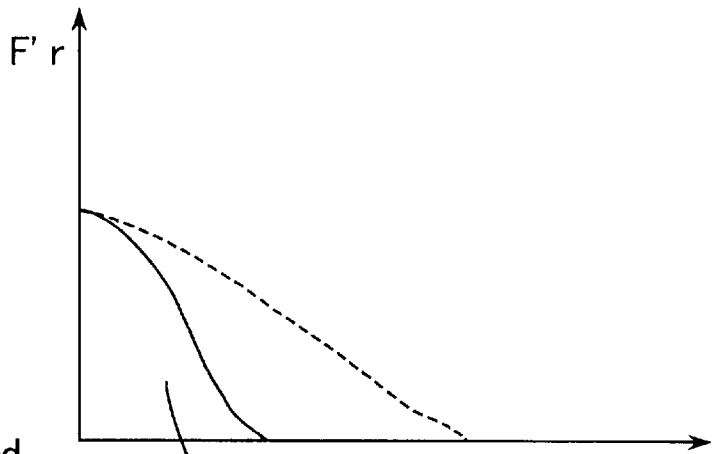
FIGS. 24A to 24D are diagrams showing frequency spectrums of the color difference components of the original image, the smoothed additional image, the pattern image, and the synthesized image.
Figure 24A:
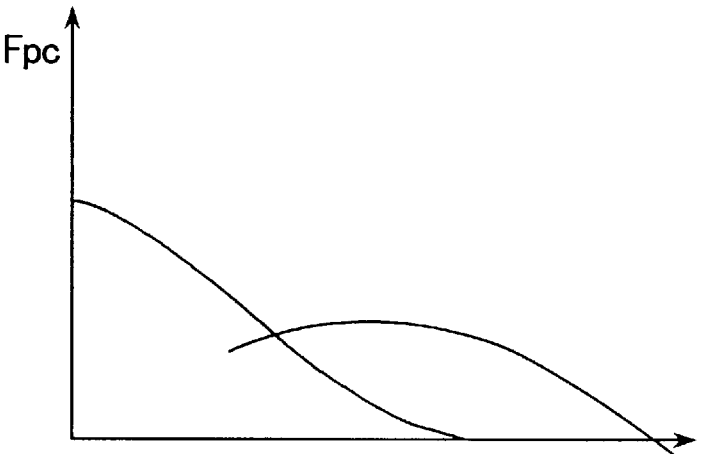
Figure 24D:
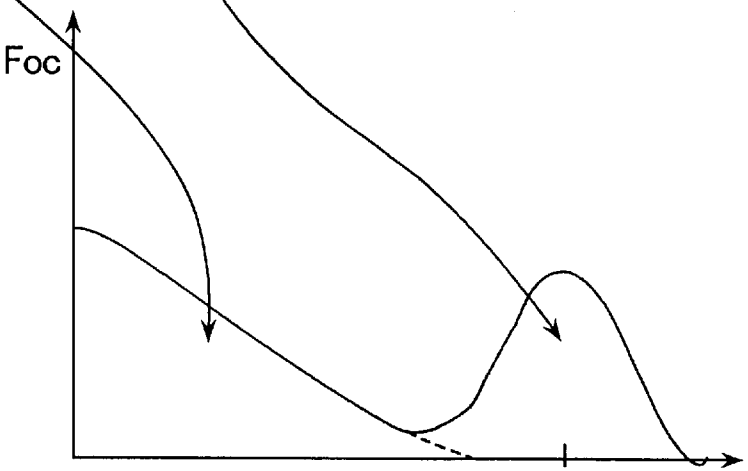
Figure 24C:
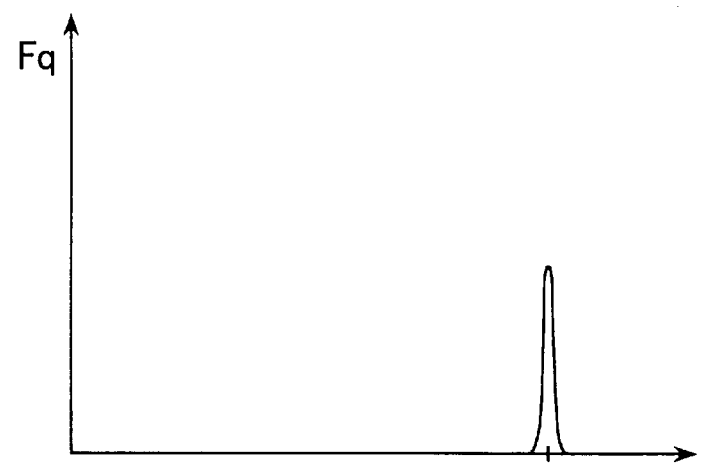

FIGS. 24A to 24D are schematic views showing Fpc, Fr', Fq and Foc in Equation (11-2). Power of spectrum Fpc(fx, fy) of the color difference component of a usual image is, as shown in FIG. 24A is concentrated to the low frequency component, while the high frequency component is considerably low. On the other hand, the smoothed additional image R' is, as indicated by a continuous line shown in FIG. 24B, in the form in which the high frequency component of the additional image R is omitted as indicated by a dashed line shown in FIG. 24B. The pattern image Q has only high frequency component, as shown in FIG. 24C. Therefore, the spectrum of the color difference component of the synthesized image expressed by Equation (11-2) is, as shown in FIG. 24D, separated into a first term mainly having the low frequency component and a second term mainly having the high frequency component.

Figure 25:
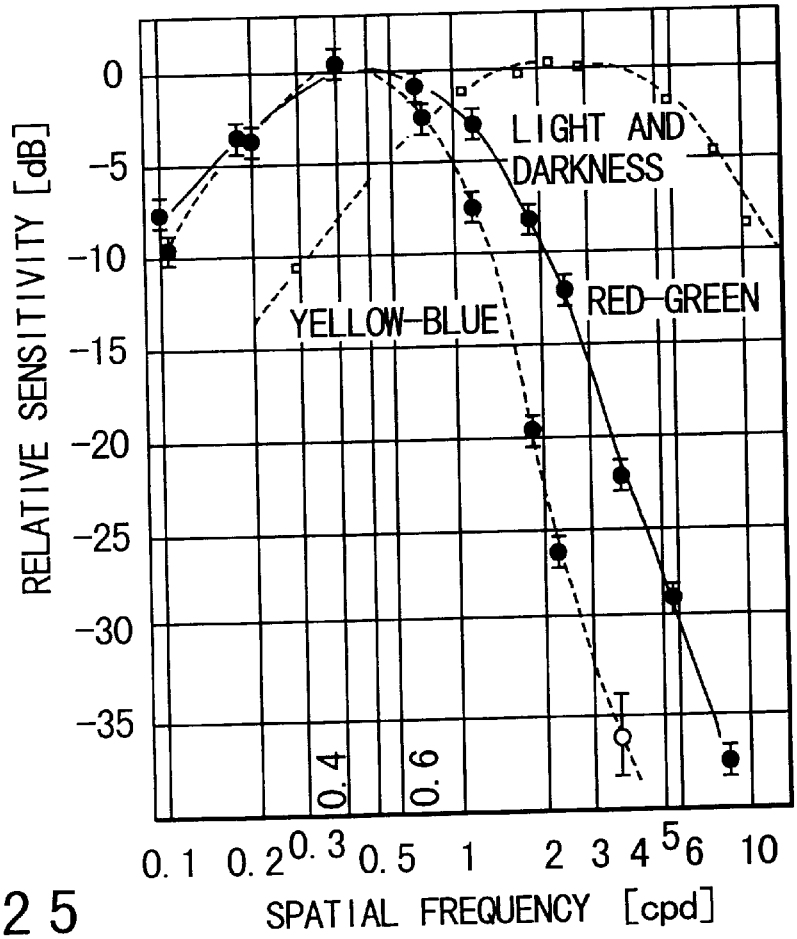
FIG. 25 is a diagram showing the chromaticity spatial frequency characteristic of visibility.

As shown in FIG. 25, the visibility of a human being is low with respect to a high frequency component. Therefore, the second term of Equation (11-2) cannot substantially be recognized by a human being. As a result, only the first term of both of the luminosity component and the color difference component of the synthesized image is observed. That is, the synthesized image is recognized to be the same as the original image.

As described above, the image synthesized and recorded in this embodiment is an image which is visually recognized to be substantially the same as the original image. Since the component of the additional image is the color difference component having the high spatial frequency, it cannot substantially visually be recognized by a human being. Since the high frequency component of the color difference component fp1(fx, fy) of a usual image is reduced due to the smoothing process of the additional image, a component which is shifted to a low frequency due to convolution of the additional image and the pattern image can be eliminated.

An image reproducing system for reproducing an additional image from the thus-recorded synthesized image will be described specifically.

Figure 26:
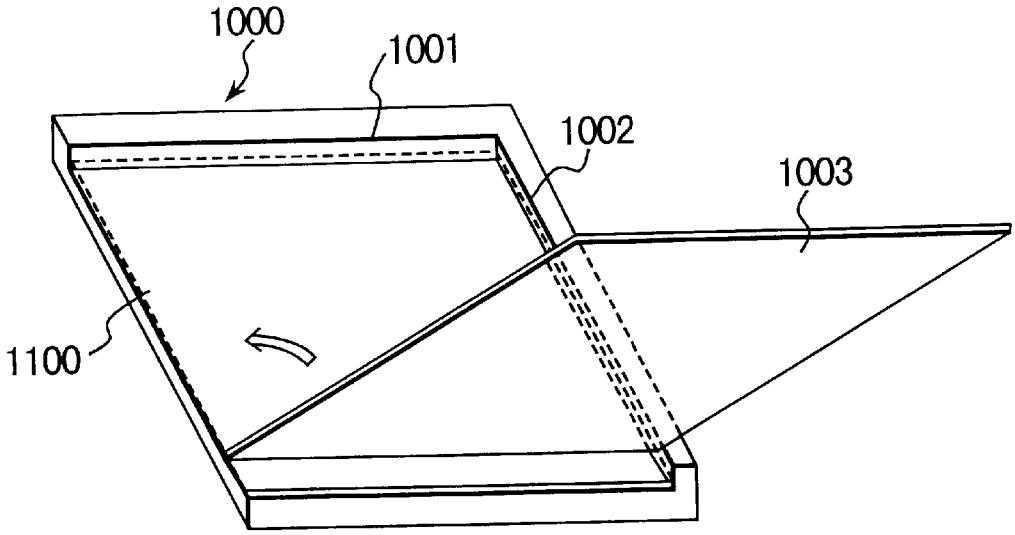
FIG. 26 is a perspective view showing the structure of an image reproducing system according to the fifth embodiment.

FIG. 26 is a diagram showing an example of the structure of the image reproducing system. A recorded product (recording paper) 1100 having the synthesized —image recorded thereon is placed on and secured to a system body 1000 in such a manner that the top end and the right end of the recorded product 1100 are in contact with a top end 1001 and a right end 1002 of the system body 1000. As a result, a reproducing sheet 1003 and the image on the recorded product 1100 are held to have a predetermined positional relationship. Then, the reproducing sheet 1003 connected to the system body 1000 is superimposed on the recorded product 1100. Then, the image on the recorded product 1100 is observed through the reproducing sheet 1003 so that the additional image is recognized to be superimposed on the original image.

The image reproducing system is not limited to the structure shown in FIG. 26. If the relative position between the synthesized image on the recorded product 1100 and the reproducing sheet 1003 can be secured, any structure may be employed. Another structure may be employed in which the reproducing sheet 1003 is not secured with respect to the recorded product 1100 and the reproducing sheet 1003 is made to be arbitrarily movable by the hand in the one-dimensional direction or the two-dimensional direction to align the reproducing sheet 1003 to a position at which the additional image on the recorded product 1100 is required to be reproduced. Since the contrast of the reproduced additional image is lowered if the distance from the reproducing sheet 1003 and the recorded product 1100 is long, a structure may be employed in which the reproducing sheet 1003 is pressed by a rigid and transparent plate to shorten the distance to be, for example, not longer than 1 mm.

The structure of the reproducing sheet 1003 and the principle for reproducing the additional image will now be described. The reproducing sheet 1003 is made of a transparent and film-like thin medium, for example, plastic resin. A predetermined pattern is formed on the medium.

The pattern on the reproducing sheet 1003 is provided with an appropriate transmittance distribution to correspond to the pattern when the synthesized image has been produced, that is, the pattern (the pattern of the pattern image generated by the pattern generating unit 903 shown in FIG. 23) of the pattern image generated in first step S11 shown in FIG. 18. The RGB transmittance distributions Tr(x, y), Tg(x, y) and Tb(x, y) of the reproducing sheet 1003 are expressed by Equation (12). Note that (Wr0, Wg0, Wb0) and (Wr1, Wg1, Wb1) respectively indicate the RGB transmittance of a pixel having the value of the pattern image Q(x, y) of 1 and −1. In this embodiment, white (transparent) and black are employed as expressed by Equation (13-1).

$$Tr(x, y) = 0.5 \cdot (Wr0 - Wr1) \cdot Q(x, y) + 0.5 \cdot (Wr0 + Wr1) \quad (12)$$

$$Tg(x, y) = 0.5 \cdot (Wr0 - Wg1) \cdot Q(x, y) + 0.5 \cdot (Wr0 + Wg1)$$

$$Tb(x, y) = 0.5 \cdot (Wr0 - Wr1) \cdot Q(x, y) + 0.5 \cdot (Wr0 + Wb1)$$

$$(Wr0, Wg0, Wb0)=(0, 0, 0)$$

$$(Wr1, Wg1, Wb1)=(1, 1, 1) \quad (13\text{-}1)$$

FIG. 27 shows the transmittance distribution pattern of the reproducing sheet 1003. Referring to FIG. 27, symbol W represents a transparent portion, K represent an opaque portion, and portions W and K correspond to pixels of the pattern image Q(x, y) shown in FIG. 19 and having gain −1 and gain 1. By superimposing the reproducing sheet 1003 having the foregoing transmittance pattern on the recorded product 1100, the pattern on the reproducing sheet 1003 and the component of the pattern image Q(x, y) of the synthesized image on the recorded product 1100 interfere with each other. Thus, the additional image is observed as a yellow/blue color difference image superimposed on the original image.

The reproducing sheet 1003 may have another structure as expressed by Equation (13-2) such that the portions W and K shown in FIG. 27 are replaced by portions for permitting Y and B to transmit. In this case, the additional image is observed as a monochromatic gray level image superimposed on the original image.

$$(Wr0, Wg0, Wb0)=(1, 1, 0)$$

$$(Wr1, Wg1, Wb1)=(0, 0, 1) \quad (13\text{-}2)$$

The reproducing sheet 1003 may be produced by the recording section of the foregoing image synthesizing and recording system or an independent image recording system. Since image recording systems sometimes have different recording density, a required accuracy can easily be obtained by producing the reproducing sheet 1003 by the image recording system of the image synthesizing and recording system.

When the reproducing sheet 1003 is superimposed on the recorded product 1100, superimpose-recorded color difference information as additional image and having a high frequency is shifted to the low frequency region so that the image is visually recognized by the eyes of a human being. The reason for this will now be described.

RGB reflectances Or, Og and ob of the synthesized image are expressed by Equation (9). Therefore, assuming that the RGB reflectances of an image observed by superimposing the reproducing sheet 1003 on the recorded product 1100 are Sr, Sg and Sb, they are expressed by Equation (14). Note that the green and blue components are similar to the red component and therefore they are omitted.

$$\begin{aligned} Sr &= Or \cdot Tr \\ &= Pr(x, y) \cdot Tr(x, y) + Q(x, y) \cdot Vr \cdot (-2 \cdot R'(x, y) + 1) \cdot Tr(x, y) \\ &= Pr(x, y) \cdot Tr(x, y) + Q(x, y) \cdot Vr \cdot (-2 \cdot R'(x, y) + 1) \cdot (0.5 \cdot (Wr0 - Wr1) \cdot Q(x, y) + (0.5 \cdot (Wr0 + Wr1)) \\ &= Pr(x, y) \cdot Tr(x, y) + 0.5 \cdot Vr \cdot (Wr0 - Wr1) \cdot Q(x, y)^2 \cdot (-2 \cdot R'(x, y) + 1) + 0.5 \cdot Vr \cdot (Wr0 + Wr1) \cdot Q(x, y) \cdot (-2 \cdot R'(x, y) + 1) \\ &= Pr(x, y) \cdot Tr(x, y) + 0.5 \cdot Vr \cdot (Wr0 - Wr1) \cdot (-2 \cdot R'(x, y) + 1) + 0.5 \cdot Vr \cdot (Wr0 + Wr1) \cdot Q(x, y) \cdot (-2 \cdot R'(x, y) + 1) \end{aligned} \tag{14}$$

Note that g and b components are expressed similarly.

The spectrum distribution of each of the first, second and third terms of Equation (14) is shown in FIGS. 28A to 28C. The first term indicates an image equivalent to an image obtained by superimposing the reproducing sheet 1003 on the original image, and the third term is the color difference component having a high frequency which cannot visually be recognized. On the other hand, the second term is obtained by multiplying the additional image by the chromaticity (Vr·(Wr0−Wr1), Vg·(Wg0−Wg1), Vb·(Wb0−Wb1)). Although the third term indicates the color difference component in this embodiment, it has been demodulated to the same frequency as that of the additional image, it is a visible image. Therefore, an image obtained by adding an image, the chromaticity of which has been modulated with additional image, to the original image, which is the first term, can be observed.

If the reproducing sheet 1003 is the sheet having the pattern expressed by Equation (13-2), chromaticity (Vr·(Wr0−Wr1), Vg·(Wg0−Wg1), Vb·(Wb0−Wb1)) are monochrome components. Therefore, an image obtained by adding a pattern modulated image, obtained by modulating the density thereof with the additional image, to the original image is observed.

As described above, the image synthesizing and recording system according to the present invention enables to record a synthesized image, obtained by superimpose-recording the additional image on the original image, and visually recognized similarly to the original image and free from deterioration in the quality. By superimposing a predetermined reproducing sheet on the recorded product having the synthesized image recorded thereon, a superimpose-recorded additional image can easily be reproduced in such a manner that the image can easily visually be recognized without a necessity of a complicated signal process.

<Sixth Embodiment>

A sixth embodiment of the present invention will now be described.

Although the fifth embodiment has the structure such that the regular pattern was employed as the pattern image and the reproducing sheet, this embodiment employs an irregular pattern. Although the basic structure of the image synthesizing and recording system according to this embodiment is the same as that according to the fifth embodiment, the process flow is somewhat different from that according to the fifth embodiment.

Figure 29:
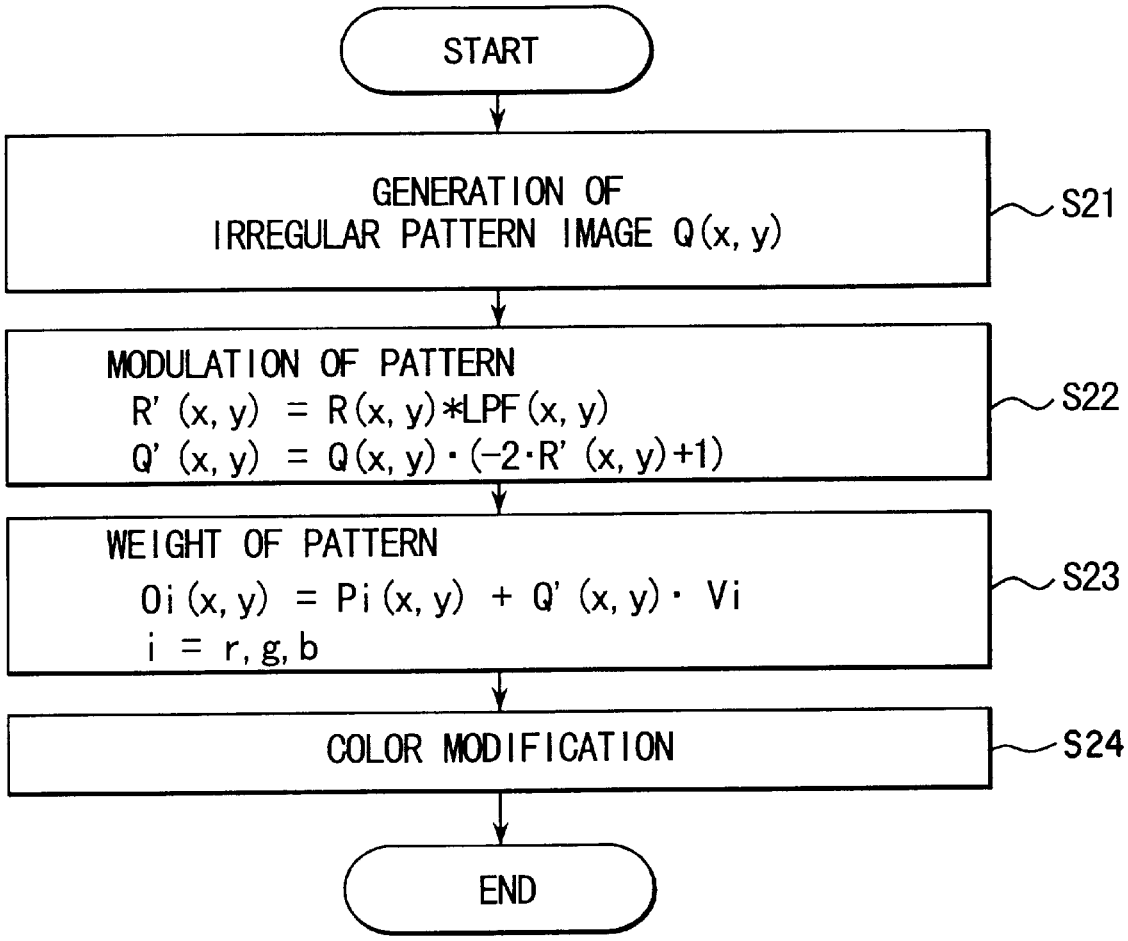
FIG. 29 is a flow chart showing the image processing process according to a sixth embodiment.

Then, the flow of the process of the image synthesizing and recording system according to the sixth embodiment will now be described with reference to a flow chart shown in FIG. 29 such that different portions are mainly described.

[First Step (Generation of Pattern)]

In first step S21, pattern image Q(x, y) is generated. Although the pattern image Q(x, y) according to the fifth embodiment is the regular pattern image, an irregular image or an image obtained by enlarging the irregular pattern image is used in this embodiment.

It is desirable that the irregular pattern image satisfies (1) the DC and low frequency spectrum are zero and the intensity of the high frequency component is strong and (2) the structure of the pattern image cannot easily be estimated from the additional image. In this embodiment, an irregular pattern image is generated by a two-dimensional Markov probability process. That is, transition probability Prob is defined as function f of predetermined pixel value Q(x+axi, y+ayi) around a pixel of interest (x, y). By using the probability Prob, the value of the pattern image Q(x, y) is determined to be 1 or −1. The foregoing state is expressed by Equation (15).

$$\begin{aligned} &\text{Prob}\,[Q(x, y), 1] = f(Q(x+axi, y+ayi)) \\ &\text{Prob}\,[Q(x, y), -1] = 1 - f(Q(x+axi, ayi)) \\ &(\text{where, Prob}\,[\text{Q(x, y), a}]\ \text{is a probability that}\ Q(x, y) = a) \end{aligned} \tag{15}$$

While arbitrarily scanning (x, y), the foregoing process is repeated. Thus, all of binary and irregular pattern image Q(x, y) are generated. The function f according to this embodiment is expressed by Equation (16).

$$f(Q(x + axi, y + ayi)) = \sum_i Q(x + axi, y + ayi) / \sum_i \tag{16}$$

Figure 30A:
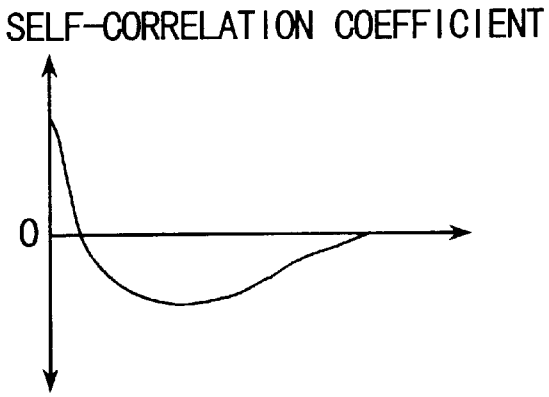
FIGS. 30A and 30B are graphs showing auto-correlation coefficients and power spectrum of an irregular pattern image according to the sixth embodiment.
Figure 30B:
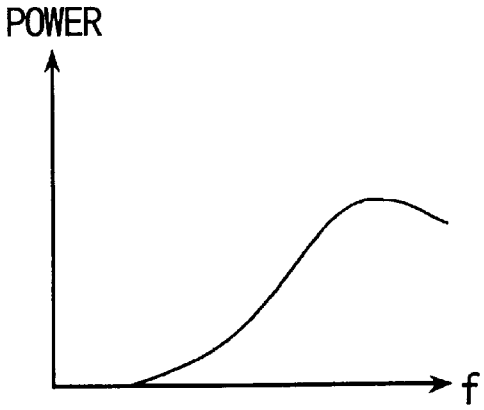
Figure 31A:
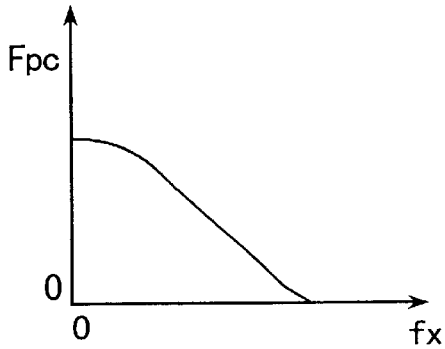
FIGS. 31A to 31D are graphs showing frequency spectrums of color difference components of an original image, a smoothed additional image, a pattern image, and a synthesized image.
Figure 31B:
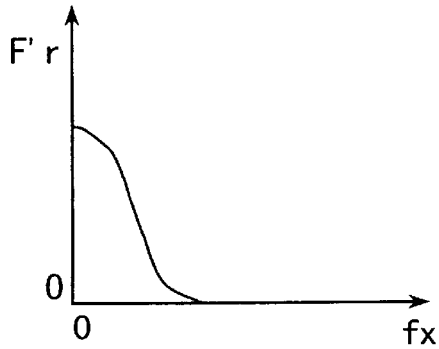
Figure 31C:
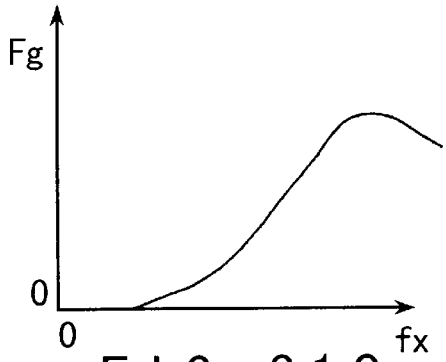
Figure 31D:
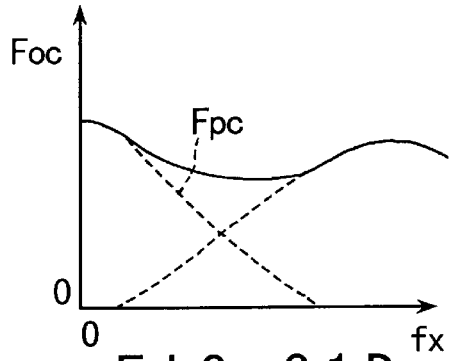

FIGS. 30A and 30B show the auto-correlation function and power spectrum of the thus-generated binary and irregular pattern image Q(x, y). Note that FIGS. 30A and 30B show only the x-axial component in order to simplify the description. As shown in FIGS. 30A and 30B, the power of the pattern image Q(x, y) is substantially zero in a low spatial frequency and the power is concentrated in high frequencies.

In this embodiment, a pseudo-random number sequence, such as M series, is employed to generate the probability image on the computer. That is, pseudo-random number D having a value in a range from 0 to N-1 with a uniform probability is generated by one for one pixel. Then, the value of the pattern image Q(x, y) is determined in accordance with Equation (17).

If D/N≧Prob, then $Q(x, y)=1$

If D/N<Prob, then $Q(x, y)=-1$ (17)

In this case, if the type of the pseudo-random number sequence and the function f are stored, same pattern images can be generated without exception. The necessity of storing the pattern image Q(x, y) can be eliminated.

Since the foregoing process has the structure such that the pattern image Q(x, y) is generated by the Markov process, the amount of calculations is enlarged. Accordingly, a random number sequence may directly be used to determine the pixel value of the pattern image Q(x, y). As an alternative to this, a pattern generated by an error diffusion process may be employed. In the latter case, white noise is generated and the values of the DC component and the low frequency component cannot be reduced. However, the calculation of the pattern image Q(x, y) can significantly be simplified. In the latter case, the low frequency component can be reduced. Moreover, the image can be calculated in a determinism manner, the random number generation process can be omitted.

[Second Step (Modulation of Pattern)]

[Third Step (Superimposing of Pattern)]

[Fourth Step (Color Modification)]

In second, third and fourth steps S22, S23 and S24, modulation of the pattern, superimposing of the pattern and the color modification are performed sequentially. Thus, the obtained images are synthesized. Since the foregoing processes are the same as those according to the fifth embodiment, they are omitted from description. Since the pattern is irregular and has no periodicity, the pattern modulation process does not employ the phase modulation on the assumption of the periodic pattern exemplified in the fifth embodiment.

As a result, a synthesized image of the original image and the additional image can be recorded. Similarly to the fifth embodiment, the synthesized image is visually recognized to be substantially the same as the original image. Moreover, information of the additional image cannot be recognized or cannot substantially be recognized.

The characteristic of the synthesized image according to this embodiment will be described specifically.

RGB components Or(x, y), Og(x, y) and Ob(x, y), the luminosity component Oy(x, y) and color difference component Oc(x, y) of the synthesized image are expressed by Equations (9) and (10), similarly to the fifth embodiment. Moreover, spectrum Foy(fx, fy) and spectrum Foe(fx, fy) of the luminosity component Oy(x, y) and the color difference component Oc(x, y) are expressed by Equations (11-1) and (11-2). Only the contents of the spectrum Fq of the pattern image Q(x, y) are different from those according to the fifth embodiment.

Since the luminosity component Vy of the color difference quantity V is set to be zero or sufficiently approximate zero similarly to the fifth embodiment, the second term of Equation (11-1) is zero. Since also Fq is set to have the low frequency component in a small quantity as shown in FIG. 30B, the second term of Equation (11-2) which is the convolution of Fq and Fr+δ is a signal having a considerably weak low frequency component. That is, the contribution of the second term of Equation (11-2) to the low frequency component of the color difference component of the synthesized image is considerably small. Since the color difference component having a high frequency is a low visibility, substantially only the component of the first term, that is, the original image is observed in the synthesized image.

FIGS. 31A to 31D show spectrum distributions of Fpc, Fr' and Foc of Equation (11-2).

Since the low frequency component of Fq is not perfectly zero, the contribution of the additional image R(x, y) to the low frequency component is made to be greater. Since the low frequency component of the irregular pattern, which is the pattern image Q(x, y) to be produced, can be controlled with the function f, arbitrary setting of the function f enables design to be performed in such a manner that it cannot be visualized satisfactorily. Since disorder of the regular pattern can easily be detected, use of the irregular pattern as the pattern image Q(x, y) enables the influence of this to be eliminated sufficiently.

A method of reproducing the additional image from the synthesized image recorded by the method according to the sixth embodiment will now be described. Also in this embodiment, a method similar to that according to the fifth embodiment is employed to reproduce additional information. However, the reproducing sheet 1003 is different from that according to the fifth embodiment. In this embodiment a sheet having the same structure as that of the pattern image for use in the image synthesizing and recording system according to the sixth embodiment is employed.

The RGB transmittance distributions Tr(x, y), Tg(x, y) and Tb(x, y) of the reproducing sheet 1003 according to this embodiment are expressed by Equation (18). The transmittance distributions according to this embodiment have the same form as those according to the fifth embodiment and expressed by Equation (12). However, the difference in the pattern image Q(x, y) causes the contents of the same to be different.

$$Tr(x, y) = 0.5\cdot(Wr0 - Wr1)\cdot Q(x, y) + 0.5\cdot(Wr0 + Wr1) \quad (18)$$

$$Tg(x, y) = 0.5\cdot(Wg0 - Wg1)\cdot Q(x, y) + 0.5\cdot(Wg0 + Wg1)$$

$$Tb(x, y) = 0.5\cdot(Wb0 - Wb1)\cdot Q(x, y) + 0.5\cdot(Wb0 + Wb1)$$

Values of parameters Wr0, Wr1, Wg0, Wg1, Wb0 and Wb1 and modifications of the parameters are expressed by Equations (19-1) and (19-2).

(Wr0, Wg0, Wb0)=(0, 0, 0)

(Wr1, Wg1, Wb1)=(1, 1, 1)

(Wr0, Wg0, Wb0)=(1, 1, 0) (19-1)

(Wr1, Wg1, Wb1)=(0, 0, 1) (19-2)

Similarly to the fifth embodiment, by superimposing the reproducing sheet 1003 on the recorded product 1100 as shown in FIG. 26, the patterns interfere with each other so that a yellow/blue color difference image in which the additional image is superimposed on the original image is observed.

The principle of producing the additional image according to this embodiment will now be described. Assuming that synthesized RGB reflectances in the case where the reproducing sheet 1003 has been superimposed on a recorded product having the synthesized image recorded thereon are Sr, Sg and Sb, they can be expressed similarly to those expressed in the fifth embodiment. Since $Q(x, y)^2$ is always 1 in this embodiment, Sr(x, y) is expressed by Equation (20) similarly to Equation (14).

$$Sr = Qr \cdot Tr \tag{20}$$
$$= Pr(x, y) \cdot Tr(x, y) + 0.5 \cdot Vr \cdot (Wr0 - Wr1) \cdot (-2 \cdot R'(x, y) + 1) + 0.5 \cdot Vr \cdot (Wr0 + Wr1) \cdot Q(x, y) \cdot (-2 \cdot R'(x, y) + 1)$$

Figure 32A:
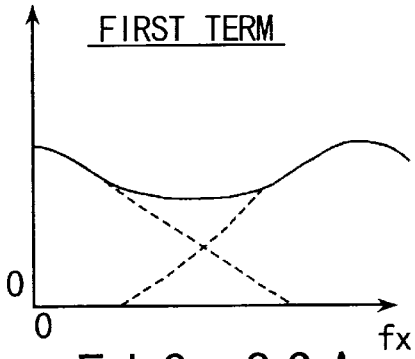
FIGS. 32A to 32C are graphs showing frequency spectrum of an image obtained by superimposing a reproducing sheet according to the sixth embodiment has been superimposed on a recorded product.
Figure 32B:
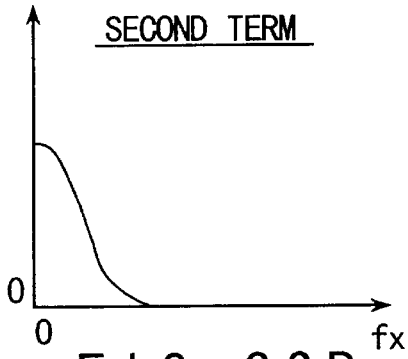
Figure 32C:
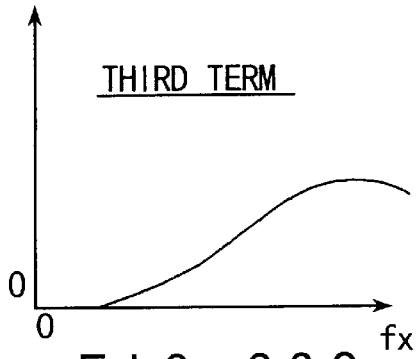

FIGS. 32A to 32C show spectrum distributions of the first, second and third terms of Equation (20). Similarly to the fifth embodiment, the first term is an image equivalent to the image obtained by superimposing the reproducing sheet 1003 on the original image. Since the third term is the color difference component having the high frequency, the image cannot visually be recognized. On the other hand, the second term is an image obtained by multiplying the additional image by the chromaticity (Vr·(Wr0−Wr1), Vg·(Wg0−Wg1), Vb·(Wb0−Wb1)) and is a visible image. Therefore, an image obtained by adding an image, the chromaticity of which has been modulated with the additional image, to the original image, which is the first term, is observed.

If the reproducing sheet 1003 has the pattern expressed by Equation (13-2) is used, (Vr·(Wr0−Wr1), Vg·(Wg0−Wg1), Vb·(Wb0−Wb1)) are monochrome components. Therefore, an image obtained by adding an image, the density of which has been modulated with the additional image, to the original image, is observed.

As described above, also this embodiment enables to record a synthesized image in which the additional image has been superimpose-recorded and which can visually be recognized similarly to the original image without deterioration in the quality of the image. By superimposing the predetermined reproducing sheet on the recorded product having the synthesized image recorded thereof, a superimpose-recorded additional image can be reproduced in such a manner that it can easily visually be recognized without a necessity of performing a complicated signal process.

In addition to the effects of the fifth embodiment, this embodiment has an advantage in that use of the irregular pattern image makes difficult estimation of the pattern of the additional image from the synthesized image. Therefore, a third party cannot easily estimate pattern information from the synthesized image to individually produce a synthesized image or reproduce the additional image. Therefore, this embodiment is suitable in a case where synthesis and/or reproduction of an image is permitted for specific persons.

<Seventh Embodiment>

A seventh embodiment of the present invention will now be described.

Although the fifth and sixth embodiments have the structure such that the pattern modulated image is superimposed on the original image by the addition process, this embodiment employs a pseudo representation process to add the pattern modulated image. In this embodiment, an ink jet printer, which is a binary image recording system, is employed as the image recording system.

Figure 33:
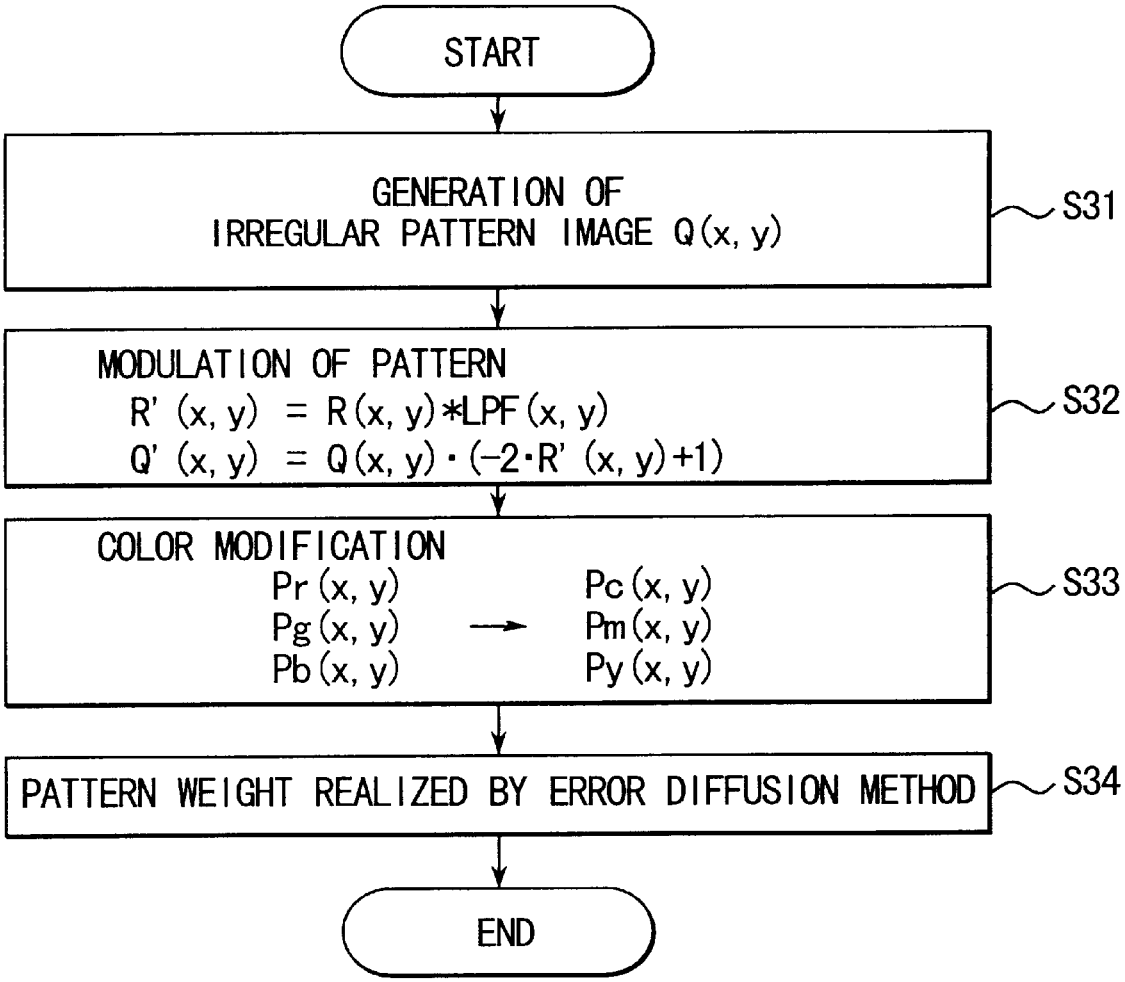
FIG. 33 is a flow chart showing an image processing procedure according to a seventh embodiment.

Also the image synthesizing and recording system according to this embodiment basically has the same structure as that according to the fifth embodiment. Only the flow of the process is different from the fifth embodiment. Referring to a flow chart shown in FIG. 33, the flow of the process will now be described.

[First Step (Generation of Pattern)]

In first step S31, the pattern image Q(x, y) is generated. As the pattern image Q(x, y), an irregular pattern similar to that according to the sixth embodiment is produced.

[Second Step (Modulation of Pattern)]

In second step S32, the pattern image is modulated with the additional image. Since this process is similar to that according to the sixth embodiment, it is omitted from description.

[Third Step (Color Modification)]

In this embodiment, a color modification process is performed in third step S33 such that original images Pr, Pg and Pb are converted into ink density signals Pc, Pm and Py indicating the controlled amount of C (cyan), M (magenta) and Y (yellow) ink. The conversion in the color modification process is similar to the color modification process according to the fifth embodiment and it is performed in accordance with Equations (21-1) and (21-2).

$$\begin{bmatrix} Dc \\ Dm \\ Dy \end{bmatrix} = \begin{vmatrix} Acr & Acg & Acb \\ Amr & Amg & Amb \\ Ayr & Ayg & Ayb \end{vmatrix} \cdot \begin{vmatrix} \log(Pr) \\ \log(Pg) \\ \log(Pb) \end{vmatrix} \tag{21-1}$$

$$Pc = \exp(Dc) \quad Pm = \exp(Dm) \quad Py = \exp(Dy) \tag{21-2}$$

[Fourth Step (Superimposing of Pattern)]

In fourth step S34 the pattern modulated image is superimposed by the error diffusion method in accordance with the ink density signals Pc, Pm and Py obtained by the color modification process. Since the pattern superimposing process according to this embodiment is considerably different from those according to the fifth and sixth embodiments, it will be described in detail. The process according to this embodiment is similar to the pseudo level representation method typified by the conventional error diffusion method. However, the pattern structure peculiar to the pseudo level representation is controlled to approximate the foregoing image pattern.

In fourth step S34, Y component Py, M component Pm and of C component Pc of the ink density signal are subjected the same process. Therefore, only the Y component Py will now be described. Fourth step S34 has the following four sub-steps S34-1, S34-2, S34-3 and S34-4.

[Sub-Step S34-1]

As expressed by Equation (22), accumulate error signal E'Y(x, y) is added to the original image P(x, y). Cumulative error signal E'Y(x, y) is used to correct quantization error during the binary coding process and a method of generating the accumulate error signal E'Y(x, y) will be described later.

$$PY'(x, y) = PY(x, y) + E'Y(x, y) \tag{22}$$

[Sub-Step S34-2]

Then, addition result PY' is binary-coded in accordance with Equation (23).

$$\text{if } PY'(x, y) + (2 \cdot P(x, y) - 1) \cdot Vy \geqq 0.5 \cdot OY(x, y) = 1 \quad \text{if } PY'(x, y) + (2 \cdot P(x, y) - 1) \cdot Vy < 0.5 \cdot OY(x, y) = 0 \tag{23}$$

where Vy is a parameter for determining the intensity of the color difference and which consists of Vm and Vc in a case of M and C components. In this embodiment, a value (Vm, Vc, Vc)=(+0.2, −0.12, −0.12) is employed. The pattern superimposing process in fourth step S34 by using the error diffusion method is different from the conventional error diffusion method in sub-step S34-2.

[Sub-Step S34-3]

An error calculation is performed in accordance with Equation (24).

$$EY(x, y)=PY'(x, y)-OY(x, y) \tag{24}$$

where EY(x, y) indicates the quantization error occurring during the binary-coding process. The error component is fed back to the input synthesized image so that the quantization error is compensated.

[Sub-Step S34-4]

Then, a accumulate error is calculated in accordance with Equation (25).

$$E'Y(x, y) = \sum_i EY(x+xi, y+yi) * ai(xi, yi) \tag{25}$$

where a(xi, yi) is a distribution coefficient for the error and a value in table shown in FIG. 39 are employed.

By repeating the foregoing process while scanning the pixels, processes for all images are performed. Also the M component and the C component are calculated similarly so that images O'y, O'm and O'c binary-coded by the error diffusion method are employed.

Although the error diffusion method is employed in this embodiment, a dither method or the like may be employed in place of the error diffusion method.

The image synthesizing process is performed sequentially as described above. Finally, the image recording unit records the images in accordance with the binary-coded output images O'y, O'm and O'c. That is, if Oy(x, y)=1, pixels (x, y) are printed by yellow ink. If Oy(x, y)=0, printing is not performed. As a result, an image can be obtained which has the density substantially the same as the density expressed by O'y, O'm and O'c which have been averaged in a macro-region.

At this time, a black printing process may be performed. The black printing process is a process in which all of the YMC images are printed by K (black) ink. This process attains an effect of reducing the printing cost because the quantity of ink can be reduced, bleeding of ink can be prevented and the density can be raised because the black ink is employed. Among a variety of suggested processes, for example, the following process may be employed to record images in accordance with O"y, O"m, O"c and O"k of the images to be printed by the black printing process. In this case, the image recording unit must record YMCK printing.

$$\begin{aligned} &\text{if } (O'y = 1, O'm = 1, \text{ and } O'c = 1) \\ &\quad Oy'' = 0, Om'' = 0, Oc'' = 0, Ok'' = 1 \\ &\text{else } Oy'' = Oy, Om'' = OM, Oc'' = OC, Ok'' = 0 \end{aligned} \tag{26}$$

As a result of the foregoing sequential process, a pattern modulated image is, as the error diffusion pattern, superimposed on the original image. A recorded image (a synthesized image) obtained by the foregoing process has the following characteristic. That is, the density is compensated due to the error diffusion process so that an image having substantially the same chromaticity as that of the original image is recorded as the synthesized image in the macro-view point. The modulated pattern image component is, similarly to the sixth embodiment, is a color difference synthesized image having a strong high frequency component which is a low visibility. Also the low frequency component existing in a small quantity is further reduced because of the density compensation effect of the error diffusion. Therefore, the contents of the pattern image modulated with the additional image cannot substantially visually be recognized.

Since the synthesized image has been binary-coded after the intensity of the pattern modulated image has been added during the error diffusion process, the binary-coded image has a significantly great collation with the pattern modulated image. That is, in accordance with the value of the modulation parameter (Vy, Vm, Vc), the binary-coded image has positive correlation if the parameter is positive. If the parameter is negative, the binary-coded image has negative correlation. The more the absolute value of the parameter, the degree of correlation becomes greater. Since Vy≧0, Vm<0 and Vc<0 in this case, the Y component has great positive correlation with the pattern modulated image. The M and C components have great negative correlation with the pattern modulated image.

On the other hand, the pattern modulated image is obtained by inverting the pattern image by the additional image. Therefore, the positive and negative correlation relationship is inverted when the pixel has an image value of the additional image of 1. That is, in a region in which the pixel value of the additional image is 0, the pattern modulated image has positive correlation with the Y component of the synthesized image. In a region in which the pixel value of the additional image is 1, the pattern modulated image has negative correlation with the Y component of the synthesized image. The pattern modulated image has positive correlation with M and C components.

A method of reproducing the additional image from the synthesized image recorded in the seventh embodiment will now be described. Also in this embodiment, the transparent reproducing sheet 1003 having a transmittance distribution corresponding to the irregular pattern image Q(x, y) is superimposed on the recorded product 1100 having the synthesized image recorded thereof, similarly to the sixth embodiment shown in FIG. 26 so that the additional image is reproduced. In this embodiment, the reproducing sheet 1003 according to the sixth embodiment is employed. That is, the transmittance distributions Tr(x, y), Tg(x, y) and Tb(x, y) of the reproducing sheet 1003 are expressed by Equation (18) above. By superimposing the reproducing sheet 1003 on the recorded product 1100, the additional image can be reproduced as a Y-B color difference signal.

The principle for reproducing the additional image by superimposing the foregoing reproducing sheet 1003 on the recorded product 1100 will now be described. As described above, in the region in which the pixel value of the additional image is 0, the pattern modulated image has positive correlation with the Y component of the synthesized image, and negative correlation with the M and C components. In the region in which the pixel value of the additional image is 1, the pattern modulated image has negative correlation with Y component of the synthesized image and positive correlation with M and C components.

Therefore, when the reproducing sheet 1003 is superimposed on the recorded product 1100, pixels printed by Y ink can easily be superimposed on the black pixels on the reproducing sheet 1003 in the region in which the pixel value of the additional image is 0. On the other hand, pixels printed by M ink and C ink can easily be superimposed on white (transparent) pixels on the reproducing sheet 1003. That is, in the region in which the pixel value of the additional image is zero, color is shifted to Probability which is the synthetic color of M and C in a macro-view point. In the region in which the pixel value of the additional image is 1, the color is shifted to Y because of the same reason. Therefore, when the reproducing sheet 1003 is superimposed, the chromaticity of the image is shifted to Y or Probability in accordance with the pixel value of the additional image. Therefore, the additional image is reproduced as information modulated by the color difference Y-B.

As described above, also the seventh embodiment enables a synthesized image having the additional image superimpose-recorded thereon can be recorded which can be visualized similarly to the original image without deterioration in the quality of the image, similarly to the fifth and sixth embodiments. By superimposing the predetermined reproducing sheet on the recorded product having the synthesized image recorded thereon, the superimpose-recorded additional image can easily visually be recognized without a necessity of a complicated signal process. Moreover, since this embodiment employs the irregular pattern as the pattern image, a characteristic can be realized similarly to the sixth embodiment in that the superimpose-recorded pattern cannot easily be estimated from the synthesized image.

As additional characteristic to those of the fifth and sixth embodiments, this embodiment has a characteristic that binary recording is performed to record the synthesized image attains an effect in that the structure can easily be applied to a case where a printer adapted to a recording method, such as the ink jet recording method in which control of multivalue density for each pixel is difficult is used.

<Eighth Embodiment>

An eighth embodiment of the present invention will now be described.

In the fifth to seventh embodiment, the reproducing sheet having the transmittance distribution is superimposed on the recorded product to reproduce additional image. This embodiment has a different structure such that an optical device having a thickness distribution is employed to reproduce the additional image.

Initially, an image synthesizing and recording system according to this embodiment will now be described. The structure and the flow of the process which is performed by the image synthesizing and recording system according to this embodiment are basically the same as those according to the fifth embodiment except slight difference in the structure of the pattern image. Then, the process according to this embodiment will now be described with reference to a flow chart shown in FIG. 34.

[First Step (Generation of Pattern)]

Figures 34, 35:
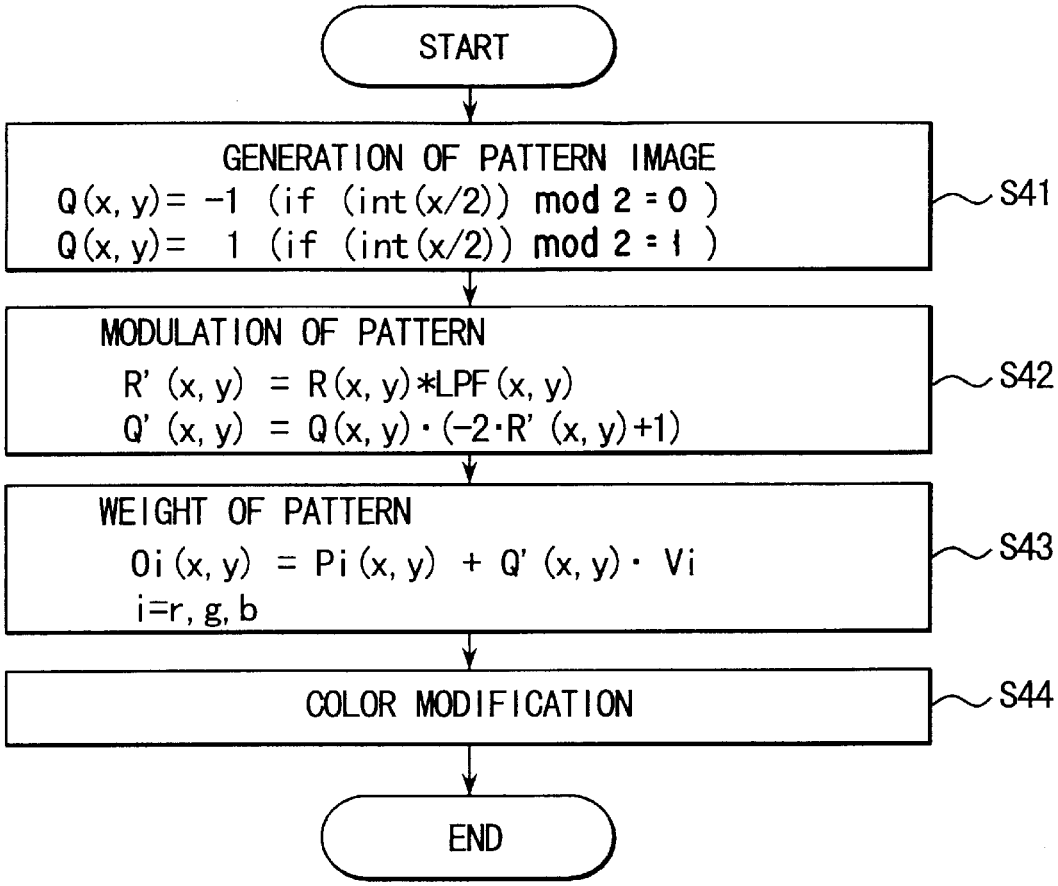
FIG. 34 is a flow chart showing an image processing procedure according to an eighth embodiment.
FIG. 35 is a diagram showing the pattern structure of a pattern image according to an eighth embodiment.

In first step S41 pattern image Q(x, y) is generated. In this embodiment, a stripe pattern image as shown in FIG. 35 is employed as the pattern image Q(x, y). The pattern image Q(x, y) is in the form in which pixels having a gain of −1 and pixels having a gain of 1, which are given to the color difference quantity (Vr, Vg, Vb), are arranged in a stripe configuration. In the case shown in FIG. 35, pixels having the gain of −1 and arranged to form two lines in the direction of the y axis and pixels having the gain of 1 and arranged to form two lines in the direction of the y axis are alternately arranged, that is, a period of four pixels is employed in the direction of the x axis. The pattern image Q(x, y) is generated in accordance with Equation (27).

$$\text{If } (\text{int}(x/2) \bmod 2=0, \text{ then } Q(x, y)=-1.$$

$$\text{If } (\text{int}(x/2) \bmod 2=1, \text{ then } Q(x, y)=1. \quad (27)$$

[Second Step (Modulation of Pattern)]

[Third Step (Superimposing of Pattern)]

[Fourth Step (Modification of Color)]

In second, third and fourth steps S42, S43 and S44, modulation of the pattern, superimposing of the pattern and modification of color are sequentially performed. Finally, the obtained synthesized image is recorded. Since the foregoing processes are the same as those according to the fifth embodiment, they are omitted from description.

Similarly to the fifth embodiment, this embodiment enables a synthesized image in the form the original image and the additional image are synthesized to be recorded. The synthesized image can visually be recognized similar to the original image and information of the additional image cannot be recognized or cannot substantially be recognized.

A method of reproducing the additional image from the synthesized image to be recorded in this embodiment will now be described. In this embodiment, an optical system is employed which comprises a cylindrical lens array, that is, a so-called lenticular lenses formed in a sheet shape.

FIG. 36 shows the structure of a lenticular lens 2000 having a structure in which a plurality of cylindrical lenses are arranged in parallel. The focal point of each cylindrical lens exists on a bottom surface 2001. The pitch of the cylindrical lens is the same as the period (which is four pixels in this embodiment) of the pattern image Q(x, y) in the direction of the x axis.

FIG. 37 is a schematic view showing a state where the lenticular lens 2000 is superimposed on a synthesized image on the recorded product. The axis (the vertical direction of the drawing sheet on which FIG. 37 is illustrated) of the cylindrical lens and the direction of the x axis of the synthesized image, that is, the direction of the period of the pattern image Q(x, y) are made to be perpendicular to each other on the synthesized image. Moreover, the center of the portion Q(x, y)=1 of the corresponding pattern image is made to be placed on the central axis of each cylindrical lens. Then, observation is performed through the upper surface of the lenticular lens 2000 so that the additional image is reproduced.

The principle for reproducing the additional image according to this embodiment will now be described with reference to FIG. 37. Since the portion of the pattern image where Q(x, y)=1 coincides with the central axis of the cylindrical lens, all of light beams are converged to the central portion of the pattern image in which Q(x, y)=1 when the image is observed from a perpendicular direction to the cylindrical lens. Therefore, a portion of the pattern image in which Q(x, y)=1 can be recognized. On the other hand, images which satisfy Q(x, y)=−1 does not contribute to the image observation. Therefore, in the region in which the pixel value R(x, y) of the additional image is zero, an image obtained by adding (Vr, Vg, Vb) can be recognized. In the region in which R(x, y)=1, an image obtained by subtracting (Vr, Vg, Vb) can be recognized. Therefore, an image, the color difference of which is shifted in accordance with the additional image, can be recognized.

In the fifth embodiment, the portion of the additional image in which R(x, y)=1 cannot visually be recognized because it is superimposed on the black portion of the reproducing sheet. In this embodiment, also the portion in which R(x, y)=1 can be recognized as color, the color difference of which has been shifted. Therefore, color difference contrast, which is twice the contrast realized by the fifth embodiment, can be realized. Since the original image portion is not shielded by the black pixels, the additional image can be observed with the original luminosity.

In the fifth embodiment, the additional image cannot be reproduced only by positioning the reproducing sheet and the position of the synthesized image to have a predetermined relationship. However, in this embodiment, even if the lenticular lens 2000 which is the reproducing optical device is shifted from a predetermined position with respect to the synthesized image, the additional image can be reproduced by moving the viewpoint. An example case shown in FIG. 38 will now be considered in which the portion of the pattern image in which Q(x, y)=1 is slightly shifted to the right from the central axis 2201. In this case, the viewpoint is moved to observe the image from a direction indicated by an arrow 2202 so that the focal point is shifted to position of Q(x, y). Thus, the additional image can correctly be reproduced.

Also this embodiment enables an additional image, which can visually be recognized similarly to the original image, to be recorded similarly to the fifth embodiment. By superimposing a sheet-like reproducing optical device, such as the lenticular lens, having a predetermined shape, the additional image can easily be reproduced in such a manner that it can visually be recognized.

Since the lenticular lens is employed as the reproducing optical device according to this embodiment, the following significant advantages can be realized in that (1) reproduction contrast, which is twice that realized by the fifth embodiment, can be realized, (2) even if the phase of the reproducing optical device and that of the synthesized image are shifted from each other, the position, at which the highest reproduction contrast can be realized, can be obtained by moving the viewpoint, and (3) also the original image can be observed with the original luminosity.

As described above in the foregoing embodiments, according to the present invention, use of one universal optical device enables additional image, which has been superimpose-recorded from an image recorded as a hard copy and which cannot visually be recognized, to be reproduced in such a manner that it can visually be recognized.

Additional advantages and modifications will readily occur to those skilled in the art. Therefore, the present invention in its broader aspects is not limited to the specific details, representative devices, and illustrated examples shown and described herein. Accordingly, various modifications may be made without departing from the spirit or scope of the general inventive concept as defined by the appended claims and their equivalents. For example, a structure may be employed in which the contents of the recording process and the reproducing process according to the foregoing embodiments are, as software programs, stored in a recording medium, such as there for magnetic disk and optical disk, so as to be read and executed by an existing computer system.

What is claimed is:

1. A personal identification product on which at least identification information for identifying a person is printed, said identification information comprising:

visible identification image information which is composed of at least one of code data and image data for identifying a person;

additional image information which is obtained by subjecting at least one of said code data and said image data to color-difference modulation; and printing image data obtained by adding a modulated signal representative of said additional image information to at least part of a printing color signal representative of said visible identification image information, wherein the obtained printing image data is printed as said identification information on said personal identification product.

2. The product according to claim 1, wherein the at least part of the printing color signal of said visible identification image information is provided by a transformation using predetermined encoded data based on said code data in advance.

3. The product according to claim 1, wherein said additional image information results from distribution of the ink densities based on an error diffusion method.

4. The product according to claim 1, wherein said additional image information has a color difference lattice pattern.

* * * * *